US007423661B2

(12) United States Patent
Abe et al.

(10) Patent No.: US 7,423,661 B2
(45) Date of Patent: Sep. 9, 2008

(54) IMAGE DISPLAY APPARATUS

(75) Inventors: Naoto Abe, Tokyo (JP); Osamu Sagano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 624 days.

(21) Appl. No.: 10/847,415

(22) Filed: May 18, 2004

(65) Prior Publication Data

US 2004/0246277 A1 Dec. 9, 2004

(30) Foreign Application Priority Data

May 19, 2003 (JP) ..... 2003-141090

(51) Int. Cl.
*G09G 5/00* (2006.01)

(52) U.S. Cl. ..... 345/690; 345/204

(58) Field of Classification Search ..... 345/204, 345/690–695, 87–100; 348/671; 358/455, 358/456; 382/237, 274
See application file for complete search history.

(56) References Cited

U.S. PATENT DOCUMENTS

| | | | | |
|---|---|---|---|---|
| 5,734,361 | A | 3/1998 | Suzuki et al. | 345/74 |
| 6,040,876 | A | 3/2000 | Pettitt et al. | 348/624 |
| 6,127,991 | A | 10/2000 | Uehara et al. | 345/60 |
| 6,384,806 | B1 * | 5/2002 | Matsueda et al. | 345/89 |
| 6,552,702 | B1 | 4/2003 | Abe et al. | 345/75.2 |
| 6,911,963 | B2 | 6/2005 | Baba et al. | 345/88 |
| 6,940,482 | B2 * | 9/2005 | Ishii et al. | 345/98 |
| 7,015,902 | B2 * | 3/2006 | Nagai et al. | 345/204 |
| 7,071,902 | B1 | 7/2006 | Kawahara | 345/63 |
| 2002/0000982 | A1 | 1/2002 | Takagi | 345/204 |
| 2003/0011552 | A1 * | 1/2003 | Ishii et al. | 345/89 |
| 2003/0063108 | A1 | 4/2003 | Isono et al. | 345/690 |
| 2003/0112257 | A1 * | 6/2003 | Tamura | 345/690 |
| 2003/0222840 | A1 * | 12/2003 | Koga et al. | 345/89 |
| 2005/0146492 | A1 | 7/2005 | Baba et al. | 345/87 |
| 2005/0237277 | A1 | 10/2005 | Kawahara | 345/63 |

FOREIGN PATENT DOCUMENTS

| | | |
|---|---|---|
| EP | 1 005 012 | 5/2000 |
| EP | 1 229 744 | 8/2002 |
| EP | 1 267 319 | 12/2002 |
| JP | 01-209493 | 8/1989 |
| JP | 8-248920 | 9/1996 |
| JP | 10-39825 | 2/1998 |
| JP | 2000-029425 | 1/2000 |
| JP | 2000-075833 | 3/2000 |
| JP | 2001-034229 | 2/2001 |
| JP | 2002-191055 | 7/2002 |
| JP | 2002-232905 | 8/2002 |
| JP | 2002-311885 | 10/2002 |

* cited by examiner

*Primary Examiner*—Nitin Patel
(74) *Attorney, Agent, or Firm*—Fitzpatrick, Cella, Harper & Scinto

(57) ABSTRACT

Driving condition is determined so that the stimulating values of brightness with respect to drive data become closer to being regular in interval. As the drive condition, the frequency of a reference clock used for the pulse width modulation is changed to be higher than the range of high gradations in the range of low gradations in drive data. Accordingly, smaller increment in brightness in the range of low gradation and larger increment in the range of high gradations are achieved.

22 Claims, 24 Drawing Sheets

IMAGE DISPLAY APPARATUS

BACKGROUND OF THE INVENTION

1. Field of the Invention

The present invention relates to an image display apparatus such as a television picture signal, and more specifically, to an image display apparatus provided with a matrix panel.

2. Description of the Related Art

In the related art, as an image display apparatus of this type, there is a known configuration provided with a multi-electron-source in which N×M cold cathode elements (image display elements) are arranged in two-dimensional matrix of N-rows and M-columns and are interconnected in a simple matrix by M row wirings (scanning wiring) provided in the row direction and N column wirings (modulation wiring) provided in the column direction. In this specification, this configuration is referred to as "matrix panel in which the cold cathode elements are interconnected into a simple matrix". However, it is not limited to the cold cathode elements, and a configuration in which image display elements are interconnected into a matrix including a plurality of row wirings and a plurality of column wirings is also referred to as "matrix panel".

In a typical driving method, a number of image display elements (for example cold cathode elements) interconnected into a matrix, a group of elements constituting a row of the matrix (the group of element constituting a row is connected to one row wiring) is driven simultaneously.

In other words, a predetermined selected voltage is applied to one row wiring, and a predetermined modulating voltage is applied only to column wiring which is connected to cold electrode elements to be driven out of N cold electrode elements connected to the specific row wiring, so that a plurality of elements constituting one row are driven simultaneously by the difference in potential between the row wiring potential and the column wiring potential. Then all the rows are scanned by switching the selected row in sequence to form a two-dimensional image utilizing an after-image phenomenon.

There are methods of driving a matrix panel disclosed in JP-A-2000-29425, JP-A-2002-311885, and WO/1267319 of the present applicant. There are also methods of driving a matrix panel disclosed in JP-A-2002-232905 and in JP-A-1-209493.

In JP-A-2000-29425, a modulating voltage is applied by a modulation circuit of pulse width modulating system to control the cycle of a reference clock (PCLK) for a pulse width modulation. This method is adapted to realize a gradation characteristic as that of the CRT when a signal which was gamma-corrected in advance for being displayed in CRT, such as a TV signal, is supplied.

In the method disclosed in JP-A-2002-311885, a modulating voltage is applied by a modulation circuit which employs such modulation system that when a predetermined pulse width is achieved as a result of performing the pulse width modulation, the pulse width modulation is performed with the next higher potential. This method is adapted to set a plurality of potentials (V0–Vm) to realize a brightness characteristic as that of the CRT when a signal which is gamma corrected in advance for being displayed in CRT, such as a TV-signal, is supplied. This publication also discloses a technology for adapting the gradation characteristic, which is realized by the preset potential (V0–Vm) and is different from the CRT, to the gradation characteristic of the CRT by a brightness data converter.

With these methods, when a signal which is gamma corrected in advance for being displayed in CRT, such as a TV signal, is supplied, it can be displayed preferably in a matrix panel.

JP-A-2002-232905 discloses a method of implementing reproduction of colors of CRT in the LCD.

JP-A-1-209493 discloses a configuration in which the relation between the display level and the brightness which is sensed by human eyes based on light emission from a light-emitting point of a self-luminous display device is controlled to be a substantially linear.

WO/1267319 discloses a configuration in which a modulation is performed in combination of a crest value modulation and a pulse width modulation, and also a configuration in which the rising portion and falling portion of the waveform of a signal are formed into a step-form.

SUMMARY OF THE INVENTION

One of a subject which can be achieved by the invention relating to this application is to suppress the increase or decrease in total number of gradations in drive data which is to be supplied into the modulation circuit. Another subject of the invention is to realize the suppression of decrease or increase in total number of gradations in drive data which is to be supplied into the modulation circuit while realizing a high gradation display.

The invention includes the following aspects.

A first aspect of the invention is an image display apparatus including;

display elements, and a modulation circuit for generating a modulated signal modulated based on incoming drive data, the display elements performing brightness gradation display by being applied with the modulated signal, characterized in that the modulation circuit generates such a modulated signal that the difference in display brightness generated when making the display elements display by two modulated signals obtained based on the drive data having one gradation difference in a first range of gradations, which is part of the entire range of gradations of the incoming drive data, becomes smaller than the difference in display brightness in a second range of gradations, which is different from the first range of gradations, and in that a drive data converting unit for converting incoming data and outputting output signals as the drive data is provided in the previous stage of the modulation circuit, and the drive data converting unit outputs the total number of gradations of the signals outputted smaller than the total number of gradations in data to be supplied into the drive data converting unit.

Preferably, the bit width of the signal outputted from the drive data converting unit is smaller than the bit width of data to be supplied into the drive data converting unit. In the inventions described above, a configuration in which the driving amount supplied to the display element by a waveform of the modulated signal corresponding to the drive data is non-linear can be preferably employed.

In addition to the first aspect of the invention, a second aspect of the invention further includes a signal processing circuit in the previous stage of the drive data converting unit, and is characterized in that a signal processed by the signal processing circuit is supplied into the drive data converting unit.

In addition to the second aspect of the invention, a third aspect of the invention is characterized in that the signal processing circuit is a circuit to perform color adjustment process of the signal supplied into the signal processing circuit.

In addition to the second or third aspect of the invention, a fourth aspect of the invention is characterized in that the signal processing circuit is a circuit to correct a signal supplied into the signal processing circuit which corresponds to a predetermined display element out of the plurality of display elements based on the signals corresponding to other display elements.

In addition to any one of the second to fourth aspects of the invention, a fifth aspect of the invention is characterized in that the drive data converting unit outputs incoming data after having converted so that a desired relation is achieved between incoming data and the display brightness. In the respective aspects described above, by employing the modulation circuit, a smooth gradation display is enabled where needed while suppressing the total number of gradations to be supplied into the modulation circuit. However, since the relation between the drive data and the display brightness is non-linear, the drive data converting unit for converting incoming data so as to achieve a desired relation between incoming data and the display brightness is employed so that a desired relation is achieved between the actually displayed brightness and the brightness indicated by the signal which is treated in the previous stage.

In addition to the fifth aspect of the invention, a sixth aspect of the invention is characterized in that the drive data converting unit converts incoming data so as to achieve a display at a brightness instructed by incoming data. In other words, when incoming data instructs an actual brightness to be displayed, incoming data may be outputted after being converted so as to compensate the non-linear relation between drive data and the actually displayed brightness.

In addition to any one of the second to sixth aspects of the invention, a seventh aspect of the invention is characterized in that a non-linear converting unit is provided in the previous stage of the signal processing circuit, and in that the non-linear converting unit performs nonlinear conversion for moderating non-linear conversion of a signal to be supplied into the non-linear conversion unit which has been performed by a sender of the signal in order to obtain the signal. According to this aspect of the invention, for example, when the incoming signal is the signal for instructing the brightness to be displayed on which non-linear conversion has been performed, conversion to alleviate the non-linear conversion can be performed to the signal, and hence the subsequent signal processing can be preferably performed.

An eighth aspect of the invention is an image display apparatus including display elements, and a modulation circuit for generating a modulated signal modulated based on incoming drive data, the display elements performing brightness gradation display by being applied with the modulated signal, characterized in that the modulation circuit generates a modulated signal such that the difference in display brightness generated when making the display element display by two modulated signals obtained based on drive data having one gradation difference in a first range of gradations, which is part of the entire range of gradations of the incoming drive data becomes smaller than the difference in display brightness in a second range of high gradations, which is different from the first range of gradations, in that there are further provided:

a drive data conversion unit for converting incoming data and outputting output signals as the drive data to the previous stage of the modulation circuit;

a signal processing circuit provided in the previous stage of the drive data conversion unit; and a non-linear conversion unit provided in the previous stage of the signal processing circuit, and in that the non-linear converting unit performs non-linear conversion of a signal to be supplied thereinto for moderating the non-linear conversion which has been performed by a sender of the signal in order to obtain the signal.

In this aspect of the invention, the configurations of the drive data conversion unit or the signal processing circuit described in the inventions can preferably employed.

In addition to any one of the first to eighth aspects of the invention, a ninth aspect of the invention further includes a clock supplying circuit for supplying reference clock whose frequency changes at a predetermined cycle for controlling the pulse width of the modulated signal or at least one of the pulse width and the crest value transition to the modulation circuit, and is characterized in that the modulation circuit enumerates the reference clock and controls the pulse width of the modulated signal or at least one of the pulse width and the crest value transition based on the enumerated value and the drive data.

In addition to the ninth aspect of the invention, a tenth aspect of the invention is characterized in that the modulation circuit enumerates the reference clock and controls the pulse width of the modulated signal based on the enumerated value and the drive data, and the frequency of the reference clock shows the different frequencies in an area where the enumerated value is small, and in an area where the enumerated value is large. With this configuration, the non-linear relation between drive data and the display brightness can easily be achieved.

In addition to the tenth aspect of the invention, an eleventh aspect of the invention is characterized in that the modulation circuit performs a crest value modulation preference type combined modulation which is the combination of the pulse width modulation and the crest value modulation based on the incoming drive data. In the crest value preference type combined modulation, a configuration that achieve the non-linear relation between the drive data and the display brightness by unbalancing the inclement of the pulse width with respect to the increment of the drive data value can be preferably employed.

In addition to any one of the first to eleventh aspects of the invention, a twelfth aspect of the invention is characterized in that the modulation circuit enumerates the reference clock and controls the pulse width of the modulated signal based on the enumerated value and the drive data, performs the crest value modulation preference type combined modulation which is the combination of the pulse width modulation in which the pulse width is controlled and the crest value modulation for selecting at least two crest values, which bring the display elements into the different ON-states, and outputs the modulated signal to make the crest value vary in stages, in that the frequency of the reference clock is switched in stages, and in that a drive data converting unit for correcting variations in gradation by the portion in which the crest value changes in stages positioned before or after the portion at which the frequency of the reference clock is switched is provided.

In addition to any one of the first to ninth aspects of the invention, a thirteenth aspect of the invention is characterized in that the modulation circuit performs the pulse width modulation preference type combined modulation which is the combination of the pulse width modulation and the crest value modulation for selecting at least two crest values for bringing the display element into the different ON-states based on the incoming drive data, in that one of the two crest values is to be used as a crest value for the portion of the modulated signal in which the crest value is increased, which corresponds to the increased amount of the drive data in the predetermined range of gradations, and the other one is to be used as a crest value for the portion of the modulated signal in which the crest value is increased, which corresponds to the increased amount of the drive data in the range of high gradations.

In addition to any one of the first to thirteenth aspect of the invention, a fourteenth aspect of the invention is characterized in that pulse width control is performed on the waveform of the modulated signal by the slot width, in that crest value control is performed on each crest values in each slot at least in n-stages from A1 to An (where, n is an integer number equal to or larger than two, and 0<A1<A2< . . . An) corresponding to the different ON-states of the display element, and in that the waveform of the modulated signal having the portion rising to the predetermined crest value Ak (where k is an integer number between two and n inclusive) rises to the predetermined crest value Ak via the respective crest values from A1 to Ak−1 at least one slot each in sequence.

In addition to any one of the first to fourteenth aspects of the invention, a fifteenth aspect of the invention is characterized in that pulse width control is performed on the waveform of the modulated signal by the slot width, and crest value control is performed on each crest value in each slot at least in n-stages from A1 to An (where, n is an integer number equal to or larger than two, and 0<A1<A2< . . . An) corresponding to the different ON-states of the display element, and in that the wave form of the modulated signal having the portion falling from the predetermined crest value Ak (where k is an integer number between 2 and n inclusive) falls from the predetermined crest value Ak via the respective crest values from Ak−1 to A1 at least one slot each in sequence.

In addition to any one of the first to ninth aspects of the invention, a sixteenth aspect of the invention is characterized in that pulse width control is performed on the waveform of the modulated signal by the slot width and crest value control is performed on the crest value in each slot at least in n-stages from A1 to An (where n is an integer number equal to or larger than two, and 0<A1<A2 . . . An), in that the waveform which is increased in gradation with respect to the predetermined waveform of the modulated signal has such shape that a unit waveform block which is determined by the slot width and the crest value An−An−1, . . . , or A2−A1, or the difference in crest value between the crest value A1 and the crest value which is a drive threshold of the light-emitting element, is added by priority to a point where the maximum crest value Ak including k=1 is lower and the maximum crest values continue, and in that at least any one of crest values is set to have a different display brightness from the case in which the crest values 0, A1, A2, . . . An−1, An are set to values to have a linear characteristic with respect to the display brightness. In other words, under the condition that the pulse width of the modulated signal is kept constant, instead by using a crest value which can realize the first brightness level out of n−1 brightness levels obtained by dividing the difference between the brightness when the crest value is zero and the brightness when the crest value is An as A1, a crest value which can realize the second brightness level as A2, and a crest value which can realize n−1th brightness level as An−1 (condition to have a linear characteristic with respect to the display brightness), by setting at least any one of the crest values A1, A2, . . . An−1 to a value different from the above-described crest value, the brightness steps can be narrowed at the portion where the distance to the adjacent crest value is small.

In addition to the sixteenth aspect of the invention, a seventeenth aspect of the invention is characterized in that the modulation waveform is such that the waveform obtained by increasing one more gradation and adding the unit waveform block to the waveform whose number of slot with the maximum crest value Ak is S−2 (k−1) where the maximum slot value is represented by S has a shape in which the crest value of any slot out of the k+1 to the S−kth slots is changed from Ak to Ak+1.

In addition to any one of the first to seventeenth aspects of the invention, an eighteenth aspect of the invention is characterized in that the display element is a cold cathode element. It is possible to employ display elements in various configurations, such as an electron emitting element or an EL element, which is included in the invention.

In addition to the aspects of the present invention described above, a nineteenth aspect of the invention is characterized in that the display elements are interconnected into a matrix by a plurality of row wirings and column wirings, in that a row selecting circuit for selecting at least one row wiring out of the plurality of row wirings for a predetermined selection period is provided, and in that the modulation circuit supplies a modulated signal based on the drive data to the plurality of row wirings synchronously with the selection period.

In the above-described aspects of the invention, the modulation circuit generates a modulated signal such that the difference in display brightness generated when making the display element display by two modulated signals obtained based on the drive data having one gradation difference in a first range of gradations, which is part of the entire range of gradations of the incoming drive data becomes smaller than the difference in display brightness in the second range of gradations which is different from the first range of gradations. However, it is specifically preferable to consider the visual characteristic of human being and to adapt that the first range of gradations is the range of gradations lower than the second range of gradations.

In the present specification, a method of displaying includes the steps of converting a predetermined date into drive data having smaller total number of gradations than the total number of gradations in the data, generating a modulated signal such that the difference in display brightness generated when making the display element display by two modulated signals obtained based on the drive data having one gradation difference in a first range of gradations, which is part of the entire range of gradations of the drive data, based on the data becomes smaller than the difference in display brightness in the second range of gradations which is different from the first range of gradations, and performing gradation display by applying the modulated signal to the display element.

DESCRIPTION OF THE PREFERRED EMBODIMENTS

Before describing embodiments of the present invention, a method of realizing a high gradation with the small total number of gradations (the total number of displayable brightness steps) in drive data will be described.

Figure 1A:
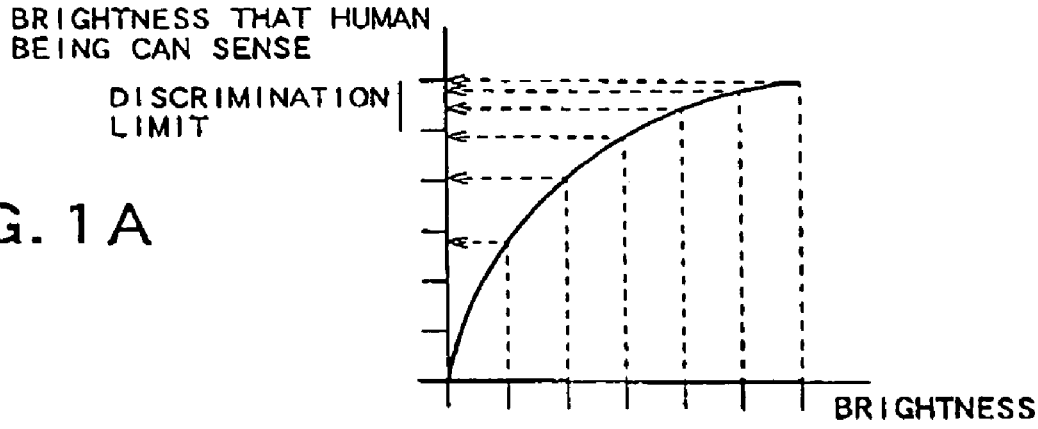
FIG. 1A is a graph modeling the human sense with respect to brightness.

In FIG. 1A, the lateral axis represents brightness, and the vertical axis represents the brightness that human being can sense, and is a graph modeling the sense of brightness of human being. The human sense including visual sense can be represented substantially by Log characteristic. The steps of brightness which generate the difference of brightness that human being can discriminate (this is referred to as discrimination limit) are regular in interval when the brightness is represented by a Log scale (known as Waber-Fechner's law).

Under the condition of FIG. 1A, when the gradation is shown with the brightness steps at regular intervals, the change in brightness at each step exceeds the discrimination limit in the range of low brightness. On the other hand, in the range of high brightness, the change in brightness at each step is below the discrimination limit. Therefore, there are brightness steps which generate the change in brightness which human being cannot sense. In other words, it is understood that there are useless brightness steps.

Under such condition that the brightness corresponds linearly to drive data to be supplied into the modulation circuit (for example, when a simple pulse width modulation is performed, and the brightness realized by the display elements corresponds linearly to the pulse width), consideration can be made with the brightness shown in FIG. 1A with drive data. In this case, the brightness changes with drive data at steps that exceed the discrimination limit in the range of low brightness. In other words, it is recognized that the number of gradations is small in the range of low brightness. In the range of high brightness, however, the brightness changes with drive data at steps below the discrimination limit, and hence human being cannot recognize that the brightness has changed. In other words, it is understood that useless drive data exists in the range of high brightness.

In particular, the inventors found that the gradation in the range of low brightness is not sufficient in the case of the equi-brightness step modulation of 10 bits (or below) (a configuration of 1024 gradation, that is the variable range of incoming drive data in the modulation circuit falls within the range from 0 to 1023, and modulation is preformed at regular brightness steps) after having devoted ourselves to study.

Figure 1B:
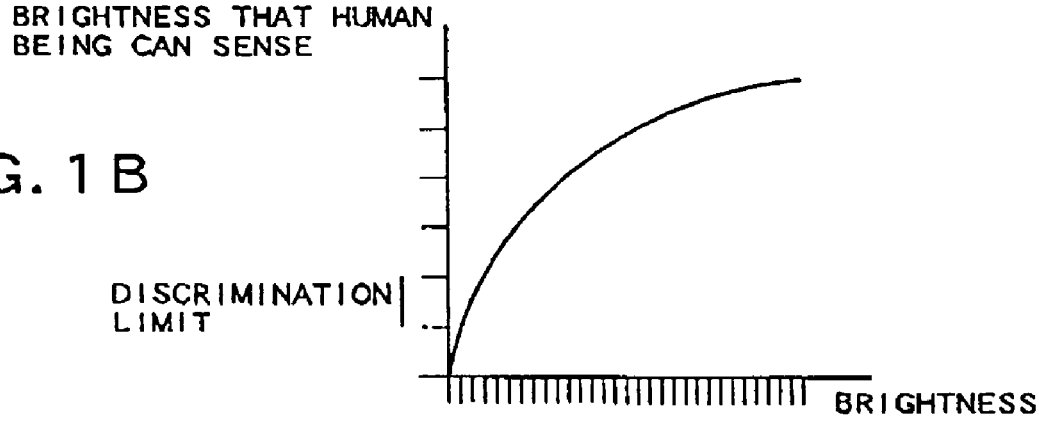
FIG. 1B is a graph showing uniform brightness steps which correspond to the discrimination limit.

FIG. 1B shows the brightness steps required for showing the gradation at such steps that human being does not recognize roughness of gradation (steps at the discrimination limit) when the gradation is shown with the brightness steps of regular intervals. It is understood that the brightness steps require a large number of brightness steps (the total number of gradations in drive data) which is the brightness steps smaller than those shown in FIG. 1A. In order to realize a large number of brightness steps, it is necessary to increase the total number of gradations in incoming drive data into the modulation circuit, which should be avoided. On the other hand, in the range other than the range of low brightness, human being cannot recognize the change of brightness with one step. In other words, if attempt is made to realize the higher gradation, the number of brightness steps (drive data, in other wards) increased in which the brightness changes under the discrimination limit in which human being cannot recognize the change of brightness. Therefore, it is understood that there exist many useless brightness steps (drive data).

Figure 1C:
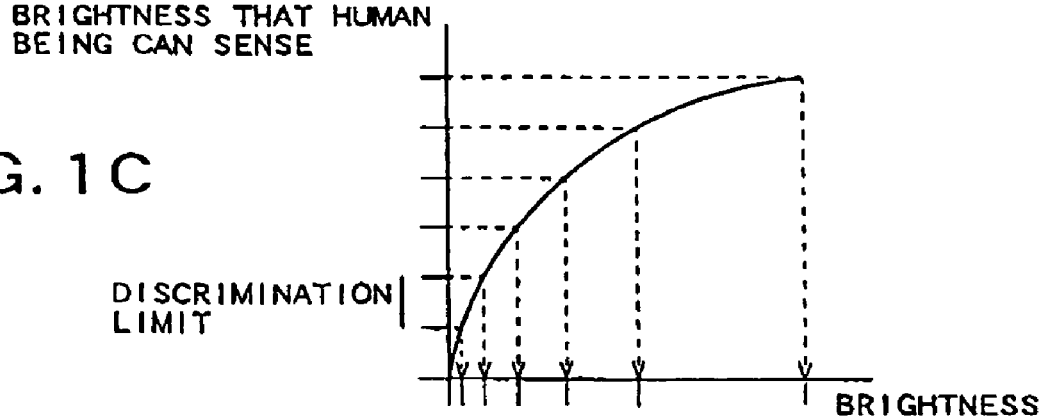
FIG. 1C is a graph showing a non-linear driving method in which the brightness steps are determined to be equal to the discrimination limit.

As described above, considering characteristics of human sense, a method of non-linear driving as shown below (drive data and the brightness are not proportional) has been studied in order to achieve presentation of desirable gradation with the small total number of gradations in drive data. In other words, as shown in the graph of FIG. 1C, a non-linear driving method has been studied in which the brightness steps in each range of gradations are set so as to generate the difference in brightness which is equal to the discrimination limit. Consequently, the number of gradations in the range of high gradations is decreased while the number of gradations in the range of low gradations is increased.

The brightness steps shown in the graph of FIG. 1C has a smaller total number of gradations in drive data in comparison with the case shown in FIG. 1B. However, it is not recognized to be bad gradation since the brightness steps are determined according to the discrimination limit of human being. In other words, according to the driving method in which the steps of brightness are determined to be equal to the discrimination limit as shown in the graph of FIG. 1C, human being perceives in the same manner as the case shown in FIG. 1B. Therefore, the high gradations can be realized with the small total number of gradations in drive data.

Although the brightness steps are discussed on the basis of the discrimination limit in FIG. 1A, FIG. 1B, and FIG. 1C, the same effect is expected even beyond the discrimination limit. In other words, by determining the brightness steps such that the differences in brightness among the respective steps are sensed by to be regular human being, gradation that can be desirably recognized is realized within the limited number of total gradation steps in the drive data.

It is not necessarily required to determine the brightness steps so that the difference in brightness that human being can sense becomes strictly regular intervals. In other words, improvement of gradation is achieved by a non-linear driving method in which the brightness steps in the range of low gradations which is a part of the area of all the gradations (the difference of brightness between the brightness obtained by a certain value in drive data and the brightness obtained by the value which is one bigger than the certain value in drive data) is set in smaller (on the normal scale) steps than the brightness steps in the area on the side higher in gradation with respect to the range of low gradations, not by a modulation method in which the brightness steps have regular intervals. In other words, improvement of gradation is achieved even with the same total number of gradations in drive data in comparison with the case in which the brightness steps are uniform in the range of all the gradations, suppression in lowering of gradation or improvement thereof when the total number of gradations in drive data is reduced is achieved, and when the total number of gradations in drive data is increased, improvement of gradation which is better than the effect achieved by such increase can be obtained.

In other words, such driving condition that, in the entire range of gradations, the difference in display brightness (brightness steps) generated when making the display elements (for example, the above-described cold cathode elements) display by two modulated signals obtained based on the drive data having one gradation difference in a predetermined range of low gradations becomes smaller than the difference in display brightness (brightness steps) in a predetermined range of high gradations is employed. In the present specification, the expressions "range of low gradations", and "range of high gradations" are used. They can be set relatively. In other words, when there are first range of gradations which is a predetermined range of gradations and a second range of gradations which corresponds to the gradations higher than the first range of gradations, the first range of gradations is the lower range of gradations with respect to the second range of gradations and the second range of gradations is the higher range of gradations with respect to the first range of gradations. Although the case in which the first range of gradations is on the lower side of the second range of gradations and the brightness steps in the first range of gradations is set to the smaller steps than the brightness step in the second range of gradations is shown in the embodiment in this specification, it is not limited thereto, and may be set as needed.

Although the total number of gradations in data supplied into the modulation circuit can be suppressed with such a construction as described above, there may arise a problem specific to this case. That is, the present inventors found that correction errors often occur when the above-described correction is performed in the same total number of gradations as the total number of gradations of input data in the modulation circuit, which is suppressed to a lower value, in the configuration in which data corresponding to the predetermined image display elements as data to be supplied into the modulation circuit takes a value on which correction is performed depending on the value of data corresponding to other image display elements, such as color temperature correction, which is correction for adjusting color, or voltage drop correction as described in U.S. Pat. No. 5,734,361.

Therefore, as described later, in the present embodiment, the configuration of performing signal processing (correction) in which the input value is 12 bits (the total number of gradations in incoming data is 4096), converting the result of the signal processing into 10 bits, and supplying it into the modulation circuit. In other words, the previous stage of the modulation circuit is adapted to convert data having the larger total number of gradations than the total number of gradations in incoming drive data into the modulation circuit into data having the smaller total number of gradations.

In particular, when performing such correction that data corresponding to the predetermined image display element depends on the values of data corresponding to other image display elements as described above, data to be corrected is preferably data proportional to the brightness (of linear characteristic). For example, it is studied and found that when performing signal processing on image data which is proportional to the brightness (of linear characteristic) for adjusting colors, calculating brightness data having a linear characteristic, and displaying it based on brightness data, the following configuration is suitable.

When the input value is a picture signal (gamma-corrected picture signal) on which correction is performed for achieving suitable display in CRT in advance, such as the TV signal, the following construction is suitable. That is, improvement of gradations is proposed by;

(1) converting the picture signal into image data having a linear characteristic when supplying the gamma-corrected picture signal as the TV signal, (2) performing signal processing (color adjustment or the like) to image data having the linear characteristic and calculating brightness data of linear characteristic, (3) converting brightness data having the linear characteristic into drive data, and (4) driving the image display element by a signal from the modulation circuit in which driving conditions (the crest value when performing modulation in which the cycle of PCLK or the crest value modulation and the pulse width modulation are combined) is set so that the brightness steps in the area of low gradations become smaller than the brightness steps in the range of high gradations, more specifically, so that the brightness steps in the respective range of gradations generate the difference of visual stimulation which is equal to the discrimination limit when drive data is incoming data to be supplied into the modulation circuit.

The converting process shown in (1) can be omitted when the incoming picture signal is not gamma-corrected. In the signal processing in (2), the object of signal processing is not limited to image data having the linear characteristic as long as it has such characteristic that signal processing can easily be performed. In this case, in (3), data having a predetermined characteristic (the characteristic that signal processing can easily be performed) may be converted into drive data corresponding to the brightness steps, such that the differences in brightness which human being senses are regular in interval.

A favorable gradations which is not different from that displayed in the total number of gradations shown in (2) can be obtained by determining the drive conditions corresponding to the human sense as described above, and further by converting into drive data in which the total number of gradations is smaller than the total number of gradations in data on which processing with a linear characteristic is performed, which is performed in (2).

Subsequently, embodiments will be described.

First Embodiment

Before describing a first embodiment of the invention, the basic operations of the driving method in the invention will be described.

Figure 2:
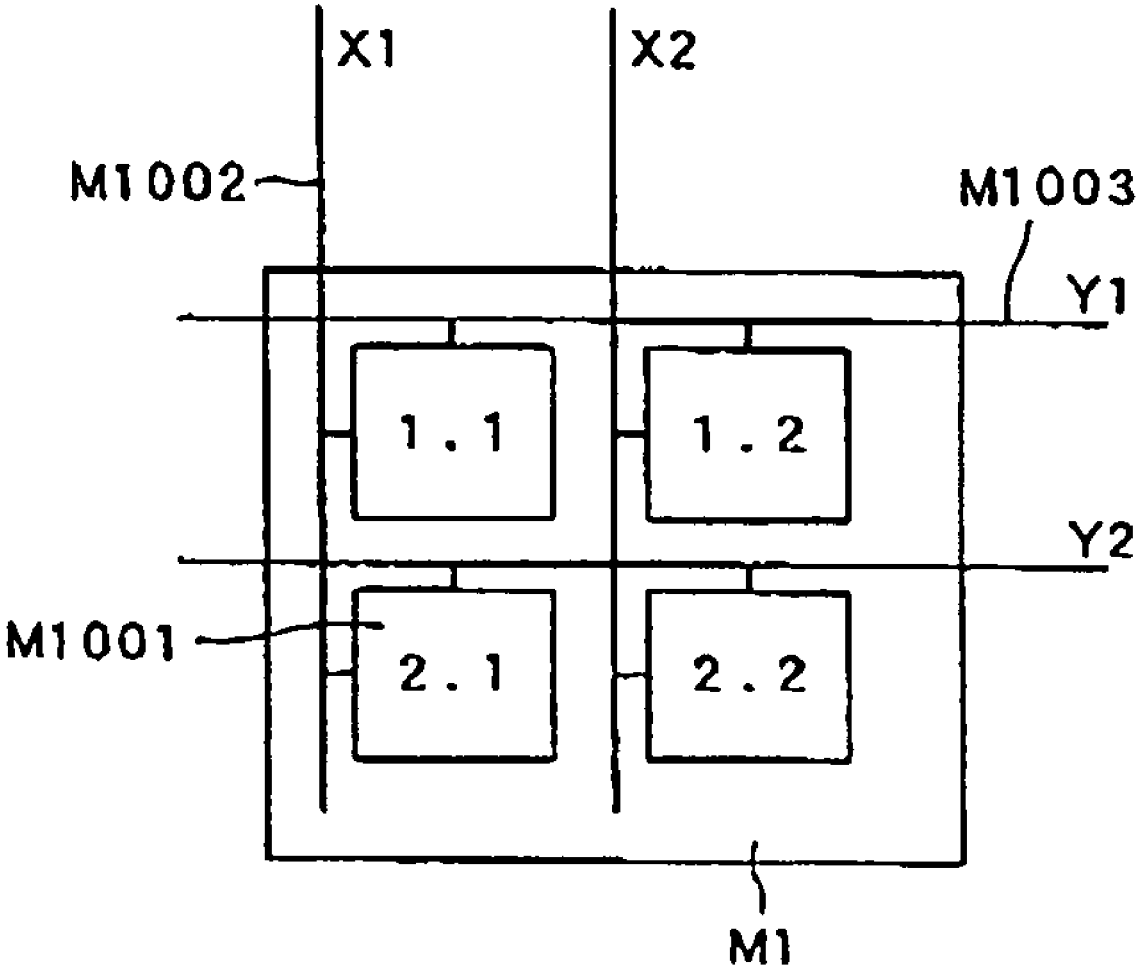
FIG. 2 is a drawing showing a matrix panel for describing the basic operation in the driving method according to the present invention.

FIG. 2 is a drawing showing a matrix panel including 2 rows×2 columns for describing the basic operation.

In FIG. 2, reference sign M1 designates a matrix panel, reference sign M1001 designates a cold cathode element as a display element, and the cold cathode element M1001 is formed on a substrate, not shown. A substrate formed of glass or the like, to which fluorescent material, not shown, is applied and a high voltage is applied, is provided so as to oppose the cold cathode element M1001, and emits light by electrons emitted from the cold cathode element M1001. Reference sign M1002 designates a column wiring, and reference sign M1003 designates a row wiring. The intersections thereof are insulated, and the cold cathode elements M1001 are connected to the intersections of the row-and-column wiring. As will be described later, the cold cathode element M1001 is preferably a surface conducting electron emitting element.

The matrix panel in FIG. 2 shows an example of monochrome display, which constitutes a display apparatus of 2×2 pixels.

In the configuration shown in FIG. 2, selected potentials are applied in sequence to the row wiring by the unit of horizontal synchronous signal of the incoming picture signal, and the column wiring is driven by a modulated signal corresponding to drive data of the selected row wiring, so that an image is formed.

In the general driving method, the following drive is performed.

Assuming that the blanking period is not taken into consideration in order to simplify the description, the selected potentials are applied in sequence during a selected period (1H: preferably, it is determined to the horizontal scanning period of the incoming picture signal). The selected period is a half the period of 1-frame of the incoming picture signal.

When displaying a certain image, a selected potential is applied to Y1 of the row wiring M1003 for the first half of the one-frame period of the incoming picture signal. Then, the modulated signal corresponding to the first scanning line is supplied to the column wiring M1002 (X1, X2) and an image of the first row is displayed. A selected potential is applied to Y2 of the row wiring M1003 for the latter half of the one-frame period of the incoming picture signal. Then, a modulated signal corresponding to the second scanning line is supplied to the column wiring M1002 (X1, X2), and the image of the second row is displayed. Consequently, a frame of image is displayed.

Figure 3:
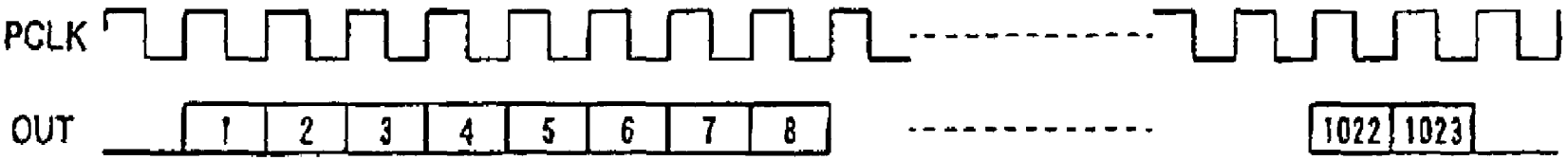
FIG. 3 is a drawing showing an waveform of a modulated signal of general PWM.

Subsequently, a method of modulating the column wiring will be described. A modulating method according to the first embodiment of the invention is a pulse width modification (PWM). The pulse width modulation enumerates a reference clock (referred to as PCLK), and outputs the pulses until becoming equal to the drive data of the corresponding column wiring. FIG. 3 shows the PCLK and a waveform of the modulated signal (OUT) from the pulse width modulator.

In FIG. 3, numerals (1–1023) in rectangular boxes of the waveform of the modulated signal mean incoming drive data into the modulator. For example, when drive data is "5", the modulated signal is outputted until the time corresponding to the numeral "5" in the rectangular box, and no output is supplied from that time on. The rectangular boxes in the waveform of the modulated signal, which represent gradations shown by numerals for convenience, are referred to as blocks or time slots. Since the crest value modulation is not used in the present embodiment, different from another embodiment described later, each time slot is constructed of one block.

Figure 4:
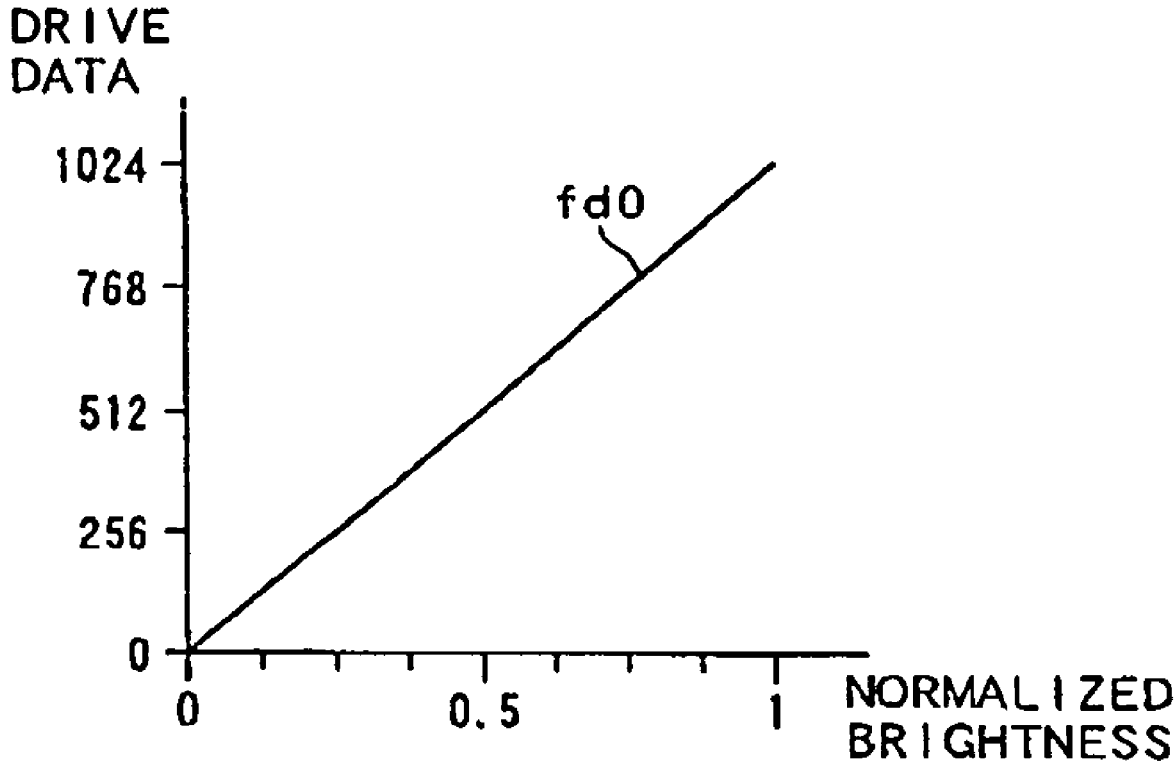
FIG. 4 is a drawing showing a brightness characteristic with respect to drive data of general PWM.

FIG. 4 shows a characteristic of normalized brightness with respect to incoming drive data.

In FIG. 4, the vertical axis represents incoming drive data of 10 bits in width, and the lateral axis represents the brightness. More accurately, although the brightness becomes discrete for discrete drive data, the characteristic is represented by a solid straight line.

As shown in FIG. 4, since the pulse width modulation is performed, the brightness shows a characteristic which is proportional to period during which the modulated signal is applied to the cold cathode element M1001 (fd0).

As described above, it is necessary to obtain sufficient gradation in the range of low brightness to cause human being to recognize a high gradation, and thus the total number of gradations (brightness steps), which corresponds to 10 bits, having a brightness-linear characteristic is not sufficient in a narrow sense.

The driving method of the invention will be described below.

The driving method of the present embodiment has following features.

(1) In the pulse width modulation system, the reference clock (PCLK) is enumerated and the pulses are outputted until it corresponds to drive data of the corresponding column wiring. Therefore, the brightness can be made non-linear with respect to drive data by controlling the cycle of PCLK.

(2) As described above, by considering the visual characteristic of human being to determine the brightness steps, a gradation characteristic which is preferable as human sense in comparison with the case in which modulation in the linear brightness steps (the differences of brightness generated by the difference of one in drive data are equal in the range of all the gradations) is realized even when the total number of gradations in drive data is the same.

(3) Signal processing of data having a linear characteristic can be performed by converting the brightness data having the linear characteristic into non-linear drive data.

By utilizing the above-described characteristics, high gradation display is achieved even with the same total number of gradations in drive data in comparison with the general driving method.

Also, by performing signal processing with high degree of accuracy by increasing the total number of gradations of the signal processing and converting brightness data into the non-linear drive data having the small total number of gradations, display without deteriorating gradation is achieved.

Figure 5:
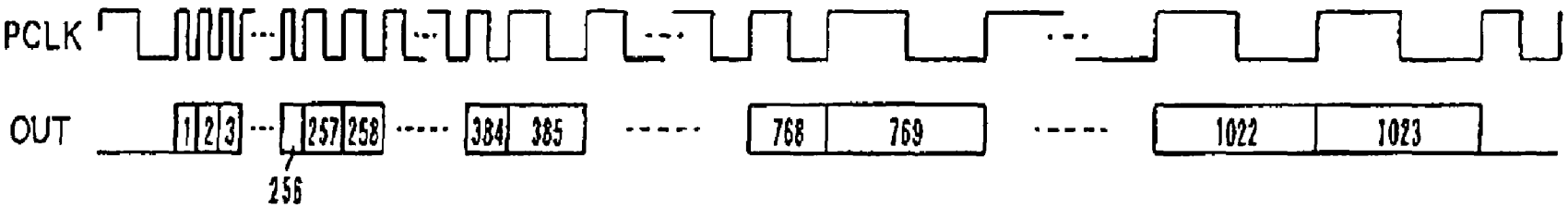
FIG. 5 is a drawing showing a waveform of a modulated signal according to a first embodiment.

FIG. 5 shows a waveform of a modulated signal according to the driving method of the invention.

In FIG. 5, the waveform of the modulated signal (OUT) is shown together with the time slots. In this embodiment, the cycle of PCLK is not constant, but variable. However, the cycle of PCLK is determined not for realizing the characteristic of the CRT, but for realizing the above-described gradation characteristic which improves the characteristic that human being can sense (to increase gradation) as described above. In other words, it is not such modulated signal that "the brightness steps are regular in interval", but is such modulated signal that the brightness steps are uneven in interval, more specifically, that the brightness steps in the range of low gradations is smaller than the brightness step in the range of high gradations. More specifically in this embodiment, the cycle of PCLK is determined so that the modulated signal that can realize such brightness steps that "the differences sensed by human being are regular in interval" can be generated.

Figure 6A:
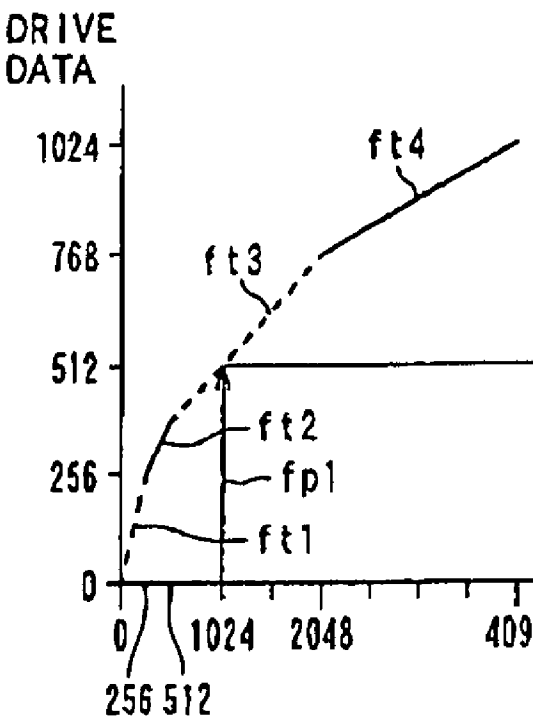
FIG. 6A is a drawing showing a characteristic of a drive data converting unit according to the first embodiment.
Figure 6B:
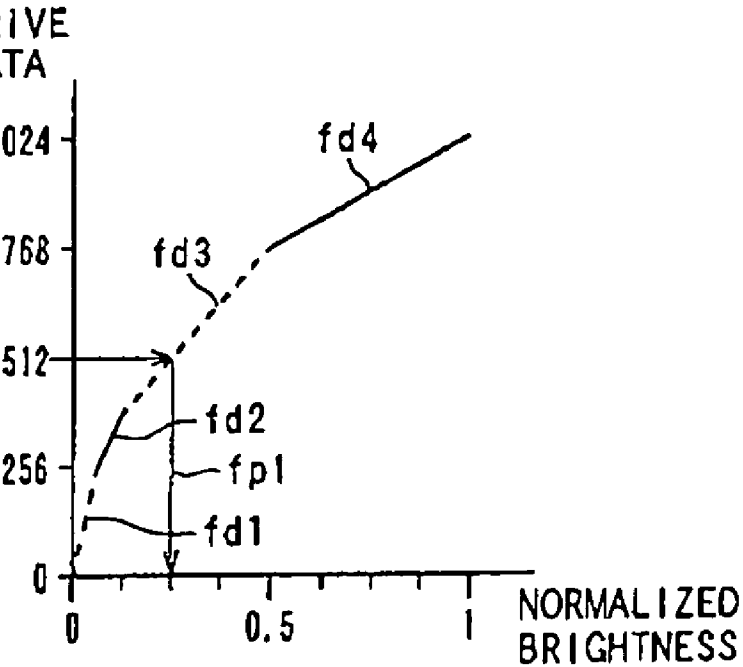
FIG. 6B is a drawing showing a brightness characteristic with respect to drive data according to the first embodiment.

FIG. 6B shows the characteristic of the normalized brightness with respect to incoming drive data. In FIG. 6B, the vertical axis represents incoming drive data of 10 bits in width, and the lateral axis represents the brightness.

For example, the frequency of PCLK is selected so as to be the frequency of fPWM for drive data from "0" to "255", half the frequency of fPWM for drive data from "256" to "383", a quarter the frequency of fPWM for drive data from "384" to "767", and eighth part of the frequency of fPWM for drive data from "768" to "1023".

The brightness at this time is, as shown in FIG. 6B, since the frequency of PCLK is high in drive data from "0" to "255", increment of brightness is small with respect to drive data, and hence inclination in the graph is significant (straight line fd1). The characteristics of drive data from "255" to "383" can be represented by the straight line fd2, drive data from "383" to "767" by the straight line fd3, and drive data from "767" to "1023" by the straight line fd4, respectively.

With the change in driving conditions as described above, the gradation in the range of low gradations, which is specially important for the visual characteristic of human being, can be increased to a gradation equal to the case in which modulation for equalizing the brightness steps is performed under much larger total number of gradations in data to be supplied into the modulation circuit, irrespective of the fact that the total number of gradations in data to be supplied into the modulation circuit is 1024. It is also effective even when the kinds of the frequencies of PCLK are reduced for simplifying the configuration of the hardware. It is further preferable to make the cycle of PCLK continuously variable by using a ROM or a VCO. Since the structure disclosed in JP-A-2000-29425 can be employed as a configuration of the actual hardware, the description will be omitted here.

A significant characteristic of the present embodiment is that the driving conditions (PCLK cycle) can be determined so that the gradation that human being senses, particularly, in the range of low gradations is improved by converting brightness data having a desired characteristic, for example, the linear characteristic, into drive data. The desired characteristic means a characteristic preferable for an intended predetermined signal processing. For example, since the linear characteristic is preferable for color processing, this is recognized as the desired characteristic.

Subsequently, a characteristic of the drive data converting unit for converting brightness data having, for example, the brightness-linear characteristic as the desired characteristic into drive data is shown in FIG. 6A. In FIG. 6A, the lateral axis represents incoming brightness data of 12 bits in width, and the vertical axis represents converted drive data of 10 bits in width. Here, the configuration in which brightness data to be supplied into the drive data converting unit has a brightness-linear characteristic is employed, and in FIG. 6A, conversion in the drive data converting unit is determined in such a manner that incoming data is converted into drive data, and brightness on which pulse width modulation is performed by drive data and displayed accordingly becomes proportional to brightness data. In other words, conversion is determined so that drive data falls within the range from "0" to "255" for brightness data in the range from "0" to "255" (straight line of ft1). It is determined so that drive data falls within the range from "255" to "383" for brightness data in the range from "255" to "511" (straight line of ft2). It is determined so that drive data falls within the range from "383" to "767" for brightness data in the range from "511" to "2047" (straight line of ft3). Then, it is determined so that drive data falls within the range from "767" to "1023" for brightness data in the range from "2047" to "4095" (straight line ft4).

Based on the description above, the operation in a case in which brightness data "1024" (brightness is a quarter the full range), for example is supplied will be described. Brightness data "1024" is converted in the drive data converting unit that will be described later into drive data "512" (fp1). Drive data "512" is supplied into the pulse width modulator that will be described later, and a modulated signal that realizes the normalized brightness 0.25 is outputted (fp2). Therefore, brightness corresponding to brightness data can be obtained. As seen in FIG. 6A and FIG. 6B, even with the pulse width modulation of data of 10 bits in width (modulation using the modulation circuit whereof the input number of total gradations is 1024), equivalent to the number of gradations corresponding in sequence to 12 bits, 11 bits, 10 bits, and 9 bits in brightness data conversion of the linear characteristic in the order from low brightness is realized.

Figure 7:
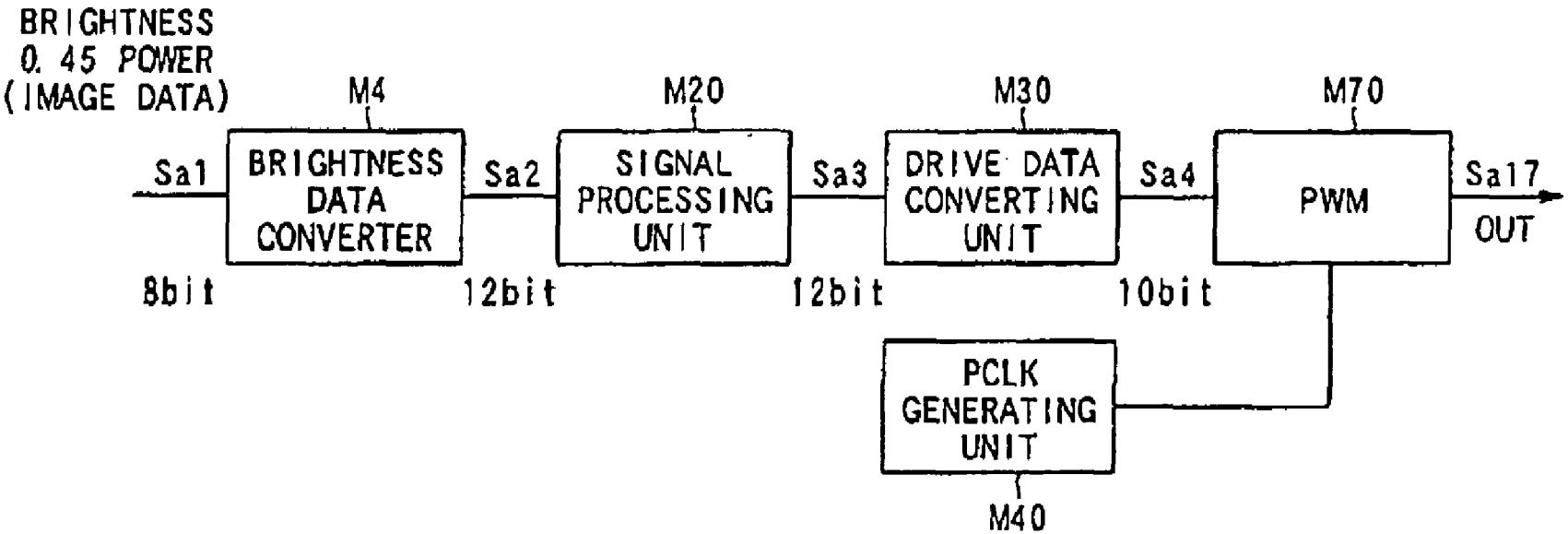
FIG. 7 is an explanatory block diagram showing the basic configuration of the first embodiment.

FIG. 7 is an explanatory block diagram showing the basic configuration of the driving method according to the present embodiment. In FIG. 7, reference sign M4 designates a brightness data converter, reference sign M20 designates a signal processing unit, reference sign M30 designates a drive data converting unit, reference sign M70 designates a pulse width modulator, and reference numeral M40 designates a PCLK generator. The brightness data converting unit M4 converts digital picture data (Sa1) which is gamma-converted, as the TV signal into image data (Sa2) having the linear characteristic. Signal processing such as color adjustment is performed on converted image data (Sa2) in the signal processing unit M20. The signal processing unit M20 outputs brightness data (Sa3) which is the result of performing signal processing. The drive data conversion unit M30 converts incoming brightness data (Sa3) into drive data (Sa4). In this conversion, conversion is performed in such a manner that the total number of gradations in outputted drive data (Sa4) is smaller than the total number of gradations in incoming brightness data (Sa3). For example, in this embodiment, the bit width of brightness data (Sa3) is determined to be 12 bits (4096 gradations), and the bit width of drive data is determined to be 10 bits (1024 gradations).

In other words, the total number of gradations in data to be supplied into the pulse width converter M70 which constitutes the conversion circuit, is 1024. In the previous stage, signal processing is performed with data whose total number of gradations is 4096, which is larger than the above-described total number of gradations, as an input, and hence signal processing can be performed with a sufficient degree of accuracy. In particular, since the total number of gradations for input is sufficient, processing of data corresponding to a predetermined image display element can be successfully performed even when it is performed depending on data corresponding to another image display element. In addition, high gradation is achieved with the small number of gradations of drive data as described above.

Subsequently, the entire configuration of the first embodiment of the invention will be described based on FIG. 8.

Figure 9:
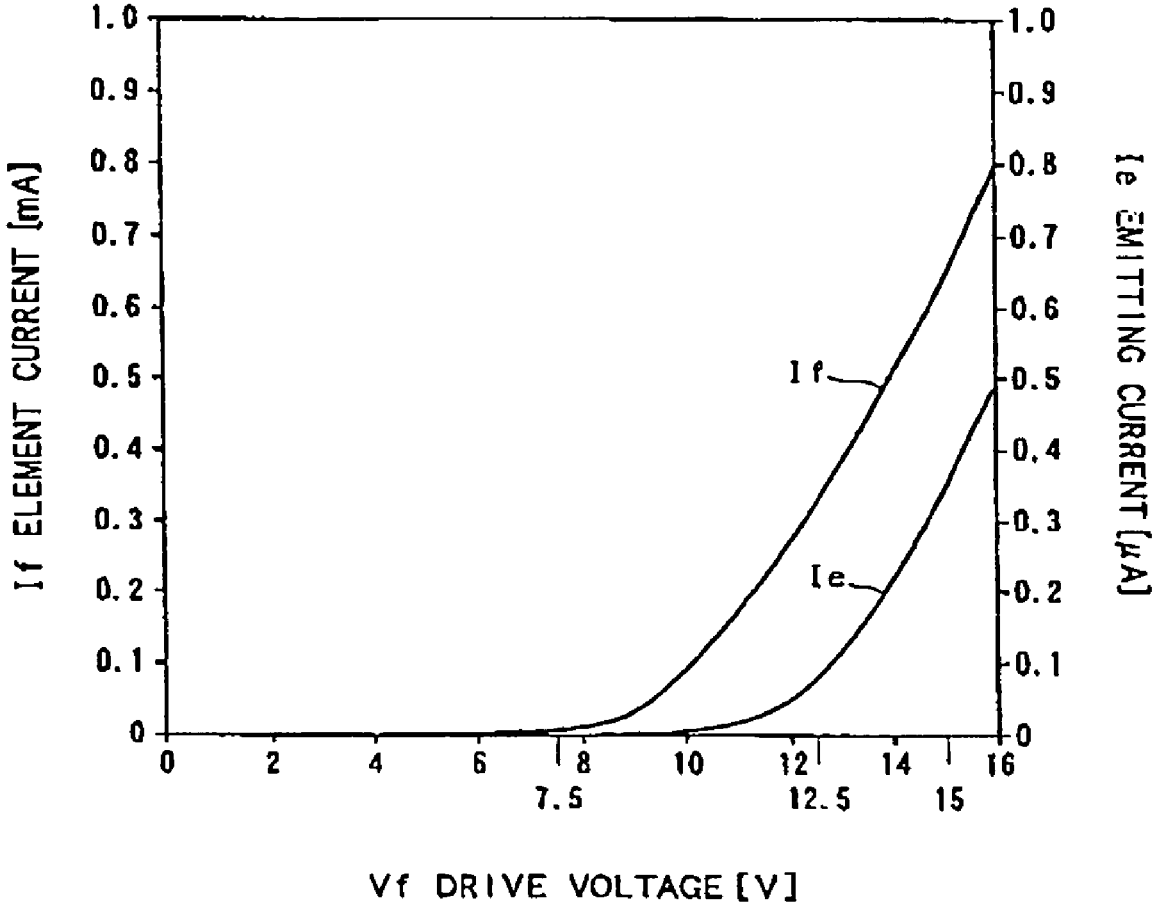
FIG. 9 is a drawing showing an example of the characteristic of the surface conducting emitting element used in the invention.

A matrix image display panel 1 to be used in the image display apparatus according to the invention includes a multi-electron source formed by arranging a number of electron sources on a substrate in a low-profile vacuum container, for example, by arranging cold cathode elements 1001, and an image forming member such as a fluorescent material for forming an image by irradiation of electrons, opposing with respect to each other. The cold cathode elements 1001 as the display elements are disposed in the vicinities of the respective intersections of column wirings 1002 and row wirings 1003, and connected to both wirings. Since the cold cathode elements 1001 can be formed at accurate positions on the substrate by using the manufacturing technology such as photolithography etching, a number of elements can be arranged at minute intervals. In addition, when compared with heat cathodes which has been used in the CRT in the related art, since they can be driven in a state in which the cold cathodes themselves or the periphery thereof are relatively at low temperature, multi-electron source with much finer array pitch can easily be realized. In the present embodiment, surface conducting emitting electrons are used as the cold cathode elements. The configuration and method of manufacturing the surface conducting emitting elements are described in JP-A-10-39825 of the present applicant in detail, and therefor it will not be described here. The actual relation among the element voltage Vf, the element current If, and the emitting current Ie of the surface conducting emitting elements are shown in FIG. 9. In FIG. 9, the lateral axis represents the electron voltage Vf of the surface conducting emitting element, and the vertical axis represents examples of the element current If and the emitting current Ie. As is clear from FIG. 9, the threshold voltage (about 7.5 V) exists in the emitting current Ie, and the emitting current Ie does not flow at a voltage below the threshold voltage. At voltages higher than the threshold voltage, the emitting current Ie flows according to the element voltage applied. Utilizing this characteristic, the simple matrix drive shown below is preformed.

Figure 8:
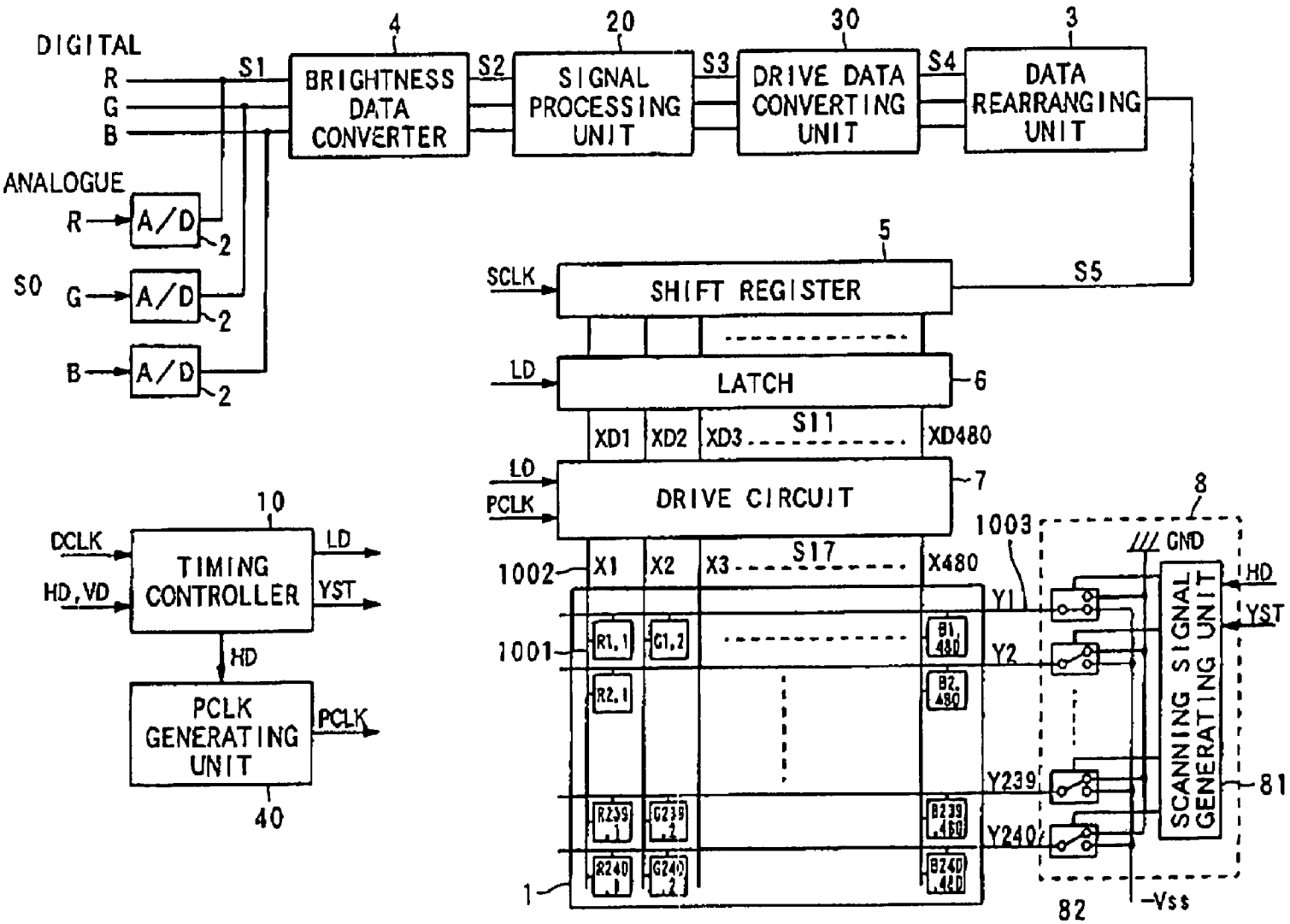
FIG. 8 is a drawing showing a drive circuit according to the first embodiment.

In FIG. 8, reference numeral 1 designates the matrix image display panel including a multi-electron source formed of the cold cathode elements 1001 arranged on the substrate in the low-profile vacuum container. As shown in FIG. 8, for example, 480 elements, that is, 160 pixels (RGB)×3 are arranged horizontally, and for example, 240 elements are arranged in the vertical direction. While an example of the matrix image display panel having 480 pixels×240 pixels is shown in the present embodiment, the number of elements is not limited thereto since it is determined by the application of the product as needed. The respective cold cathode elements 1001 of the matrix image display panel 1 are represented by Ru, v (v=1, 4, 7, . . . ), Gu, v (v=2, 5, 8, . . . ), Bu, v (v=3, 6, 9, . . . ) so as to match with the colors when the image is displayed. The matrix image display panel 1 has a pixel arrangement of, for example, RGB stripes.

Reference numeral 2 is an analogue-digital converter (A/D converter), for converting analogue RGB component signal (the name of the signal is referred to as SO) decoded for example from the NTSC signal to RGB signal by a decoder, not shown into the digital RGB signals (S1) of 8 bits in width, respectively.

Reference numeral 4 designates a brightness data converter (non-linear converting unit), and is a converting table to which the digital RGB signals (S1) from the A/D converter 2 or a computer are supplied and converted to have a desired brightness characteristic. For example, as a characteristic of the display system, inverse conversion is performed on a signal which is gamma-corrected for the CRT for converting into a characteristic in which data is proportional to brightness (linear characteristic) (image data S2). This characteristic is preferably converted into such characteristic that can easily be processed in a signal processing unit 20 that will be described next.

Reference numeral 20 is the signal processing unit (signal processing circuit), in which linear color conversion for performing, for example, color adjustment is performed to convert the color coordinate to be displayed.

Reference numeral 30 designates a drive data converting unit, in which brightness data (S3) which is processed in the signal processing unit 20 is converted into drive data (S4) Reference numeral 3 is a data rearranging unit, which has a function to rearrange drive data (S4) for each color so as to meet the pixel arrangement of the matrix panel 1 and output (drive data S5).

Although the data rearranging unit 3 is provided in the subsequent stage of the drive data converting unit 30 in FIG. 8, it is not limited thereto. It may be arranged upstream or downstream of the brightness data converter 4, the signal processing unit 20, and the drive data converting unit 30, or may be some location in between. In FIG. 8, since it is necessary to perform matrix calculation for each color when the signal processing unit 20 performs color processing or the like, the data rearranging unit 3 is provided in the subsequent stage of the drive data converting unit 30 to reduce the amount of hardware. While the portion for performing each function is illustrated in blocks in the drawings, it is not necessary to package each block independently, and a circuit that can perform the function of a plurality of blocks may be employed.

Reference numeral 5 is a shift resistor for shift-transferring drive data S5 outputted from the drive data converting unit 30 in sequence by the shift clock (SCLK), and outputting drive data corresponding to the respective elements of the matrix panel 1 in parallel. Reference numeral 6 is a latch circuit for latching drive data from the shift resistor 5 in parallel by a load signal LD synchronized with a horizontal synchronous signal and holding it for a period until the next load signal LD is supplied. Reference numeral 7 is a drive circuit for enumerating the reference clock (PCLK) as described above, and driving the column wirings of the matrix panel 1 respectively at a pulse width according to incoming drive data.

Reference numeral 8 designates a scan driver and is connected to the row wiring 1003 of the matrix panel 1. Reference numeral 81 is a scanning signal generating unit for shifting YST signal synchronized with a vertical synchronous signal of an incoming picture signal in sequence by a signal HD determined by a timing control unit 10, and outputting the selected/non-selected signals in parallel corresponding to the number of the row wirings. Reference numeral 82 is a switching means constructed of a MOS transistor or the like, which changes over the switch depending on the output level of the selected/non-selected signals from the scanning signal generating unit 81, and outputs selected potential (−Vss) and non-selected potential (GND).

Reference numeral 10 is the timing control unit which outputs a synchronous signal of the incoming image and a control signal of a desired timing formed by the data sampling clock (DCLK) or the like to the respective function blocks.

Reference numeral 40 is a PCLK generating unit as a clock supply circuit and outputs the PCLK whereof the cycle (frequency) varies as described above. The PCLK generating unit 4 may generate the clock, for example, by VCO or PLL, or may switch among a plurality of clocks and output the same.

Figure 10:
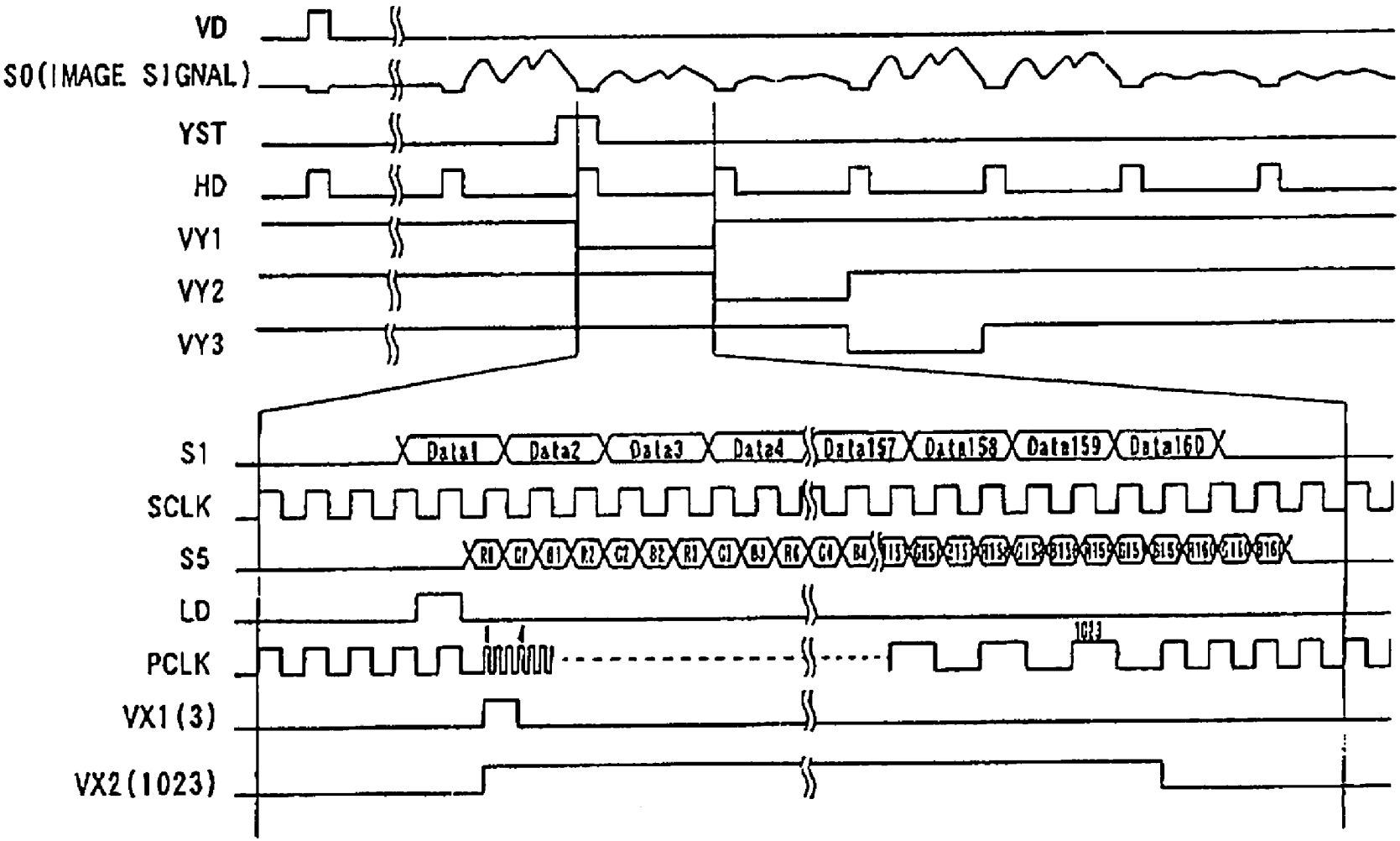
FIG. 10 is a timing diagram of the drive circuit according to the first embodiment.

FIG. 10 is a timing chart showing the entire configuration of the image display apparatus.

Referring to FIG. 8 and FIG. 10, the operation of the entire configuration of the image display apparatus will be described.

In FIG. 8, and A/D converter 2 converts, for example, an analogue RGB component signal (SO) decoded from the NTSC signal to RGB signal by a decoder, not shown, into the digital RGB signal (S1) of, for example, 8 bits in width, respectively. Thought it is not shown, it is preferably to generate a sampling clock (DCLK) by PLL based on the synchronous signal.

The brightness data converter 4 inputs a digital RGB signal (S1) which is picture data of A/D converter 2 or the computer. In this case, processing can be made easily when the number of data on one scanning line (1H) is determined by the number of pixels on the side of the column wirings on the matrix panel 1. In the present embodiment, the number of pixels on the side of the column wirings of the matrix panel 1 is determined to be 160. The digital RGB signal (S1) from the A/D converter 2 or the computer is outputted synchronously with the data sampling clock (DCLK), not shown. The brightness data converter 4 converts the digital RGB signal (S1), for example, from the A/D converter 2 or the computer into a characteristic in which, for example, the outgoing image data (S2) is proportional to the characteristic of brightness using a conversion table (ROM), not shown, in which a desired data is stored (linear characteristic) in advance. The brightness referred here means the brightness of the incoming signal source. In the case of the picture signal, which is gamma-corrected by the power of 0.45 for correcting the characteristic of the CRT as in the case of the TV, the brightness data converter 4 can convert into image data of 12 bits in width having a linear characteristic by performing inversed gamma-conversion by the power of 2.2. In a case in which signal processing is performed for the characteristics other than the linear characteristic as described above, it is preferable to convert it into the characteristic, which is required by the processing.

Figure 11:
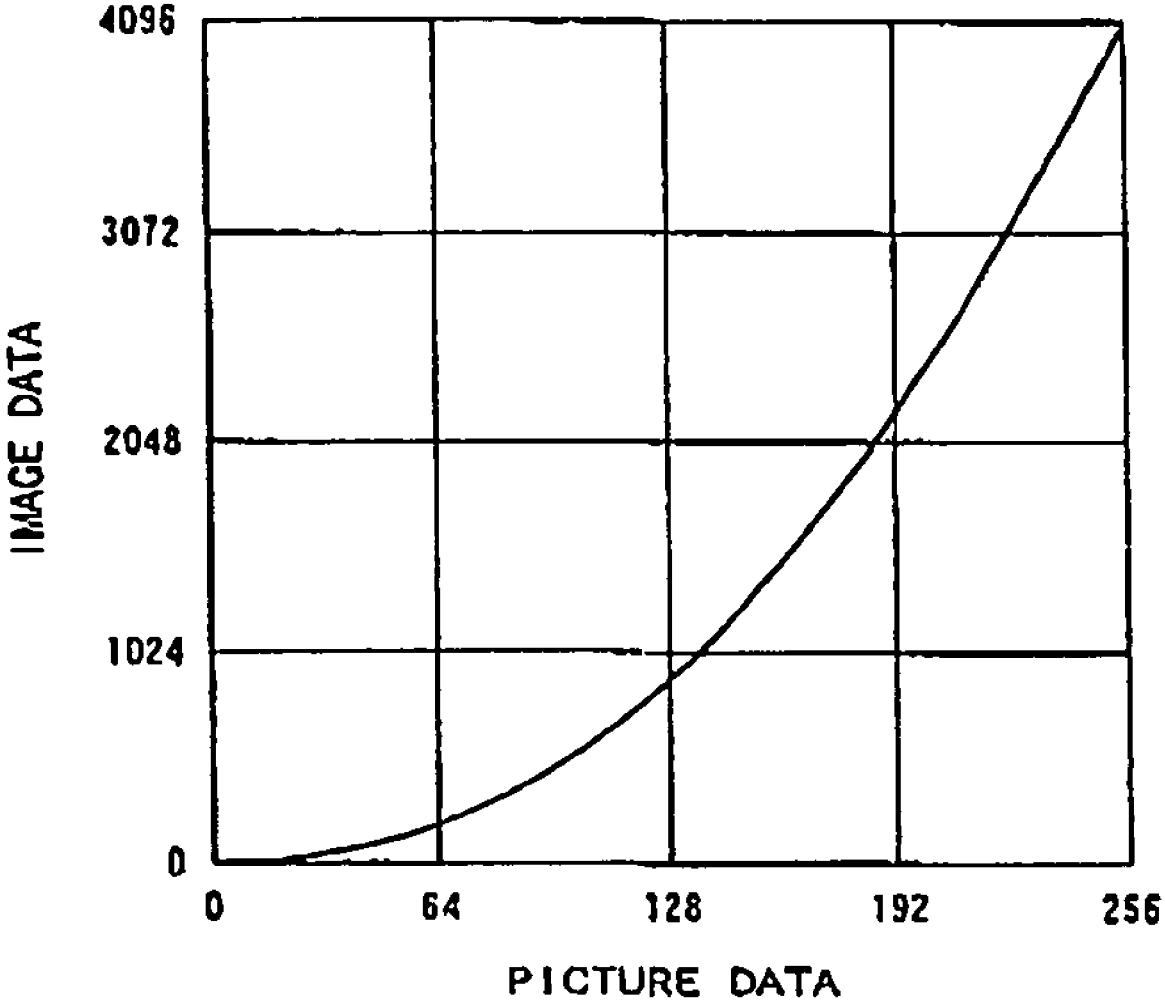
FIG. 11 is a drawing showing a characteristic of a brightness data converter 4.

An example of a characteristic of the conversion table for converting into a linear characteristic is shown in FIG. 11.

Image data (S2) of 12 bits in width that the brightness data converter 4 outputs is supplied into the signal processing unit 20. The signal processing unit 20 performs a linear color conversion, for example, for color adjustment, and converts the color coordinate to be displayed. More specifically, image data (S2) in each color is converted by a matrix calculating unit of 3 rows, 3 columns. Then, converted brightness data (S3) is outputted. The signal processing unit 20 is not limited to color adjustment, but is suitable for signal processing for correcting voltage drop of the row wirings on the matrix panel, which is disclosed in JP-A-08-248920 according to the invention of the present applicant.

Brightness data (S3) outputted from the signal processing unit 20 is supplied into the drive data conversing unit 30. The drive data converting unit 30 converts incoming brightness data (S3) of 12 bits in width having a linear characteristic into drive data (S4) of 10 bits in width in which the displayed brightness characteristic of the matrix panel becomes linear with respect to the brightness data (S3) as described above. More specifically, it is preferable to realize using a ROM table having a characteristic described later. The signal processing unit 20 and the drive data converting unit 30 realize a function to perform signal processing on incoming data (data having the total number of gradations, which is the total number of gradations suitable for signal processing, and larger than the total number of gradations in data to be supplied into the conversion circuit) and reduced the total number of gradations so as to meet the total number of gradations supplied into the conversion circuit.

Processing such as brightness adjustment (adding of offset) or the like is performed on drive data (S4) outputted from the drive data converting unit 30 as needed, and then drive data (S4) is supplied into the data rearranging unit 3. The data rearranging unit 3 has a function to rearrange drive data (S4) for each color so as to meet the pixel arrangement on the matrix panel 1 and output it (drive data S5).

The signals (drive data S4) supplied into the data rearranging unit 3 are switched at a timing of the shift clock (SCLK) having a frequency as much as three times the data sampling clock (DCLK), and are outputted in sequence from the output terminal of the data rearranging unit 3 (S5) according to the RGB pixel arrangement on the matrix panel 1.

The data rearranging unit 3 sends the output signals (S5) to the shift resister 5 of 10 bits in width and shift-transfers in sequence according to the shift clock (SCLK), and then performs serial-parallel conversion on drive data corresponding to each element on the matrix panel 1, and outputs it. Then, the latch 6 latches drive data having been serial-parallel converted when the load signal LD which is synchronized with the horizontal synchronous signal is rising and holds data until the next load signal LD is supplied.

The drive circuit 7 drives the column wirings (X1–X480) synchronously with the PCLK based on the time of the load signal LD in a manner described above.

In FIG. 10, numerals in parenthesis of VX1(3), VX1(1023) represent examples of drive data.

The scan driver 8 transfers signals (YST) for determining the scan start time in sequence synchronously with the horizontal synchronous signals (HD) to drive the row wiring as shown in FIG. 10. Then, it scans the row wirings in sequence and forms an image.

In the present embodiment, the scan driver 8 drives the row wirings from the first (Y1) to the 240th (Y240) in sequence at a selected voltage −Vss (for example, −7.5 V) synchronously with HD. In this case, the scan driver 8 drives the voltage of other row wirings, which are not selected, to the non-selected voltage, 0V.

To cold cathode elements 1001 on the row wiring selected by the scan driver 8 and on a column to which the drive circuit 7 outputs a pulse width modulated signal, Ie flows correspondingly. While the element current If does not flow to the elements corresponding to the column wirings to which the drive circuit 7 does not output the drive signal, and hence no emitting current Ie flows thereto, those elements do not emit light. The scan driver 8 drives the row wirings from the first to the 240th in sequence synchronously with the HD at the selected voltage, and the drive circuit 7 drives the corresponding row wirings with the modulated signal S17 corresponding to drive data to form a image.

The invention can be applied to a scanning system in which the scan driver 8 selects two or more row wirings simultaneously to improve the brightness.

In the present embodiment, in order to make NTSC signal display on the matrix image display panel 1 having 240 scanning wirings, 480 scanning wirings out of 485 interlaced effective scanning wirings were overwritten and driven on the matrix image display panel 1 every field. One field of NTSC signal was treated as one frame on the matrix image display panel 1. In other words, the matrix image display panel 1 was driven as a picture signal with frame frequency of 60 Hz and 240 scanning lines.

At this time, duration required for displaying one scan line was about 63.5 μsec for NTSC signal, and about 56.5 μsec within this specific duration was determined to be the maximum duration for the drive pulse for the column wirings. Therefore, since the PCLK selected the time slot 1023 for the maximum drive pulse width, a frequency, at which about 56.5 μsec can be achieved when the number of pulses of PCLK is 1023, was selected.

The frequency of PCLK was determined as described above. In other words, the characteristic shown in FIG. 6B is achieved. In FIG. 6B, the vertical axis represents incoming drive data, and the lateral axis represents the brightness.

For example, the frequency of PCLK is determined to 72.48 MHz for drive data from "0" to "255", to 36.24 MHz for drive data from "256" to "383", to 18.12 MHz for drive data from "384" to "767", and to 9.06 MHz for drive data from "768" to "1023".

The brightness at this time is, as shown in FIG. 6B, since the frequency of PCLK is high in drive data from "0" to "255", increment of brightness is small with respect to drive data, and hence inclination in the graph is significant (straight line fd1). The characteristics of drive data from "255" to "383" is represented by the straight line fd2, drive data from "383" to "767" by the straight line fd3, and drive data from "767" to "1023" by the straight line fd4, respectively.

The characteristic of the drive data converting unit 30 is the characteristic of the above-described FIG. 6B.

As described above, characteristic of the drive data converting unit 30 is determined so that drive data falls within the range from "0" to "255" for brightness data in the range from "0" to "255" (straight line of ft1), within the range from "255" to "383" for brightness data in the range from "255" to "511" (straight line of ft2), within the range from "383" to "767" for brightness data in the range from "511" to "2047" (straight line of ft3), and within the range from "767" to "1023" for brightness data in the range from "2047" to "4095" (straight line ft4).

As described above, the number of gradations corresponding to 12 bits, 11 bits, 10 bits, and 9 bits in brightness data conversion of the linear characteristic from the low brightness on is realized.

The scan driver 8 drives the row wirings from the first (Y1) to the 240th (Y240) in sequence at a selected voltage −Vss (for example, −7.5 V) synchronously with the horizontal synchronous signal HD. In this case, the scan driver 8 drives the voltage of other row wirings, which are not selected, to the non-selected voltage, 0V. In FIG. 10, voltages to be applied to the column wirings are represented by VX1, VX2 . . . , and voltages to be applied to the row wirings are represented by VY1, VY2, VY3 . . . .

As is clear from FIG. 10, the scan driver 8 has to maintain the rows to be selected at a selected voltage for the maximum duration (time slots 1 to 1023) for the drive pulse width.

As described thus far, according to the first embodiment of the invention, the drive circuit 7 which performs the pulse width modulation with drive data of 10 bits in width can achieve display with brightness resolution corresponding to the 12 bits gradation having a linear characteristic in the range of low brightness.

As described above, a high gradation is achieved with the small number of brightness steps utilizing the characteristic of the human sense. When compared with a general pulse width modulation having a linear characteristic, a characteristic corresponding to the pulse width modulation of about 12 bits can be obtained with the 10 bits pulse width modulator. In the matrix panel having a large number of pixels, manufacturing cost for the drive circuit, especially the modulation circuit is high. Therefore, the invention in which a high gradation can be achieved with the small number of drive data width (the bit width of the modulator can be reduced even with the total number of gradations which is recognized as the same) is suitable for cost reduction of the image forming apparatus.

According to the method of the invention, display at preferable gradation is achieved even when signal processing for color adjustment or signal processing for correcting the effect of voltage drop in the row wirings are performed.

Second Embodiment

A second embodiment of the invention will be described. In a first place, the basic operation of the driving method according to the second embodiment of the invention will be described. As in the first embodiment, the basic operation will be described referring to the matrix panel shown in FIG. 2. Description of the components and the general driving method in FIG. 2 are omitted.

In the second embodiment, a modulating method, which is different from that in the first embodiment, is employed. A method of modulating the column wirings will be described. The method of modulating according to the second embodiment of the invention is a modulating method in which the pulse width modulation (PWM) and the crest value modulation are combined. There are various modulating methods in which the pulse width modulation and the crest value modulation (amplitude modulation) are combined. One of these is a crest value modulation preference type combined modulation which is a method in which the crest value modulation is performed in preference to the pulse width modulation. This is modulation performed by increasing the crest value according to further increase in drive data in a state in which the pulse width is set to a predetermined value, and when all the crest values in the available range are completely used, increasing the pulse width for larger drive data, and increasing the crest value for the portion which becomes available by the increase of the pulse width according to increase in drive data.

There is also a pulse width modulation preference type combined modulation as a method of performing the pulse width modulation in preference to the crest value modulation. This method is performed by increasing the pulse width according to increase in drive data in a state in which the crest value is set to a predetermined value, and when all the pulse widths available are used completely, increasing the crest value for the larger drive data, and increasing the pulse width for the portion of the increased crest value according to increase in drive data.

In the crest value modulation preference type combined modulation or the pulse width modulation preference type combined modulation, a predetermined condition may be set to the available range of crest values or the available range of pulse width. For example, in the crest value modulation preference type combined modulation, it is possible to set a condition for limiting the available range of crest values so as to control abrupt change in crest value at the point where the crest value of the modulated signal changes. More specifically, in the rising portion and/or falling portion of the modulated signal, such condition that the available range of crest values is set to a smaller value than the crest value that the modulation circuit can output as a crest value of the modulated signal at the rising portion and/or the falling portion of the modulated signal, so that the rising and/or falling portion of the waveform of the modulated signal maintains a stepped shape without setting all the crest values in the range that the modulation circuit can output as the crest value of the modulated value as the available range of crest values can be preferably employed.

In the pulse width modulation preference type combined modulation as well, a condition to limit the available range of pulse widths can be set so as to control the abrupt change in crest value at the point where the crest value of the modulated signal changes. More specifically, such condition that the range of pulse widths available in the predetermined crest value is set to a value smaller than the range of pulse widths available in the crest value smaller than the predetermined crest value so that the rising and/or falling portion of the waveform of the modulated signal has a stepped shape without setting the range of the pulse widths available in each crest value to the same range can be preferably employed. An example of setting of these conditions is disclosed in WO/1267319.

The modulating method according to the second embodiment employs the crest value modulation preference type combined modulation. In the crest value modulation preference type combined modulation, as in the first embodiment, the configuration in which the brightness steps are varied by varying increment in pulse width of the modulated signal can be preferably employed. The configuration in which the cycle of the reference clock (PCLK; a clock to be enumerated for determining the pulse width) is made to be uneven as in the first embodiment can be employed as a configuration to make increment of the pulse width of the modulated signal uneven. In the present embodiment, the above-described condition that the rising and falling portions of the modulated signal take a stepped shape is employed. An example of the waveform of the outgoing modulated signal is shown in FIG. 12.

Figure 12:
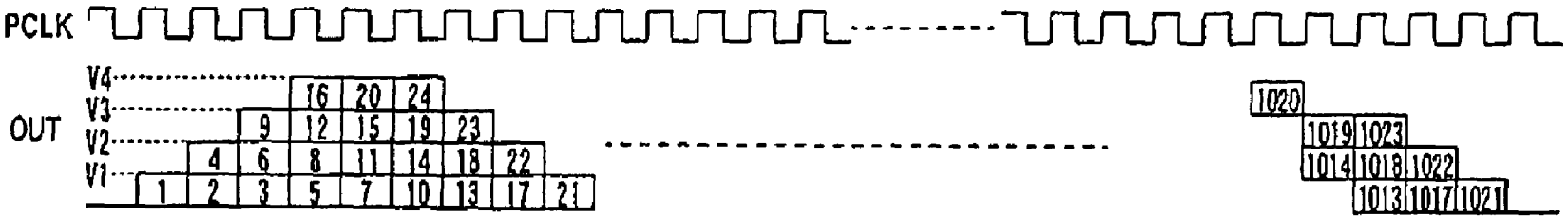
FIG. 12 is a drawing showing an example of the waveform of the modulated signal used in a second embodiment.

FIG. 12 shows the PCLK and the waveform of the modulated signal (OUT). The numerals (1–1023) in the rectangular box of the waveform of the modulated signal means drive data, and when drive data is, for example, "12", the waveform of the modulated signal is those having numerals smaller than "12" in the rectangular box. The rectangular box showing gradations is referred also to as block for convenience. The time width which is a unit of control of the pulse width is referred to as a time slot. The crest value of each slot is determined synchronously with the rising waveform of PCLK, which is the reference clock. The time slot having the crest value of any one of V2, V3, and V4 includes a plurality of blocks. However, it is not necessarily required to output the plurality of blocks independently.

Such control of waveform of the modulated signal is crest value control including pulse width control for each slot width, which is determined corresponding to the frequency of the reference clock, and crest value control for each slot width. However, as described above, the present embodiment employs a condition in which the waveform of the signal takes a stepped shape at the rising and falling portions of the modulated signal. This condition can be said as follows. In other words, it can be expressed as such control that crest value control is performed on the crest value in each slot at least in n-stages from A1 to An (where n is an integer number of two or larger and 0<A1<A2< . . . An), and has a rising portion passing via the respective crest values from A1 to Ak−1 at least one slot each in sequence to a predetermined crest value Ak (where k is an integer number between 2 and n inclusive), and a falling portion passing via the respective crest values from Ak−1 to A1 at least one slot each in sequence beginning with the predetermined crest value Ak. Here, the modulated signal has a voltage waveform, and the voltage is composed of the crest values of four stages from V1 to V4.

Figure 13:
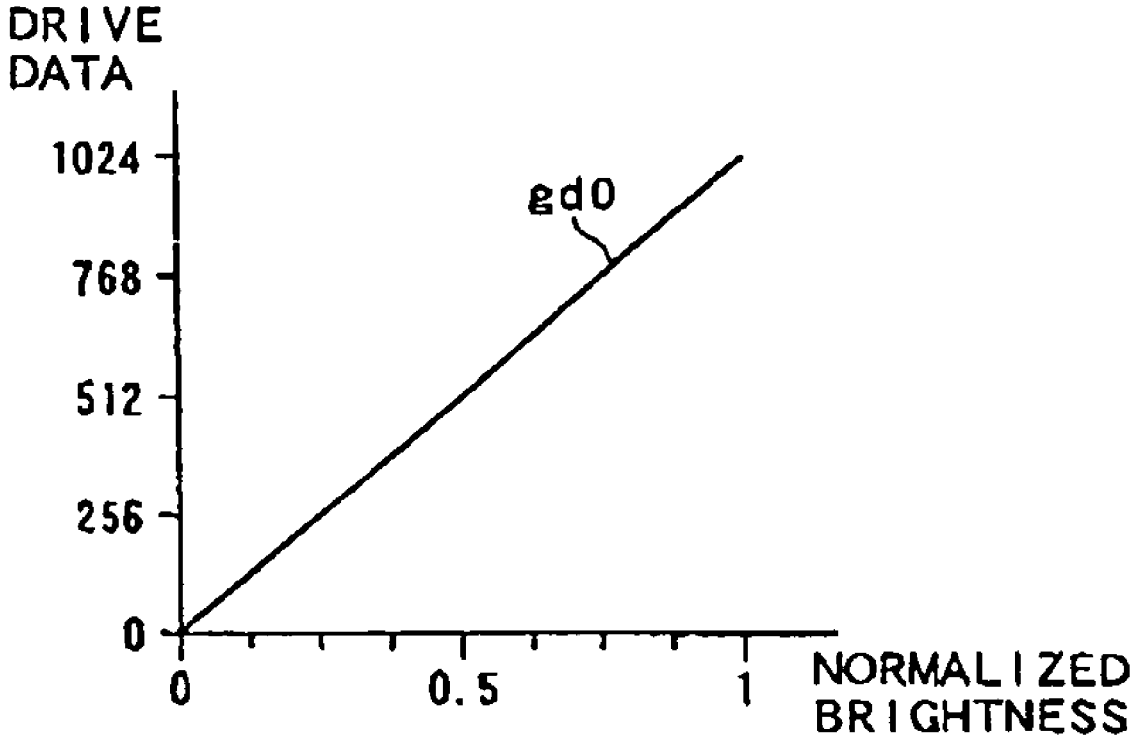
FIG. 13 is a drawing showing a brightness characteristic for drive data according to an example of the waveform of the modulated signal used in the second embodiment.

FIG. 13 shows a characteristic of normalized brightness with respect to incoming drive data in dots. In FIG. 13, the vertical axis represents incoming drive data of 10 bits in width, and the lateral axis represents the brightness. More accurately, although the brightness becomes discrete for discrete drive data, the characteristic is represented by a solid straight line.

In the second embodiment, the crest value that the modulation circuit can output is GND, which is the reference potential corresponding to the OFF state and four crest values V1, V2, V3, and V4 which correspond to the respective different ON-states.

In the present embodiment, these crest values are set in such a manner that, as a result of increment of drive data by one from a certain value, increment in brightness (brightness steps) when the crest value of the slot of a predetermined width is increased from GND to V1, increment in brightness (brightness steps) when the crest value of the slot of the predetermined width is increased from V1 to V2, increment in brightness (brightness steps) when the crest value of the slot of the predetermined width is increased from V2 to V3, and increment in brightness (brightness steps) when the crest value of the slot of the predetermined width is increased from V3 to V4 as drive data increases one from a certain value are equal with respect to each other.

In other words, in the present embodiment, the differential of the crest value is set in such a manner that the brightness steps are regular in interval with respect to drive data. In other words, diversification of the intervals of the brightness steps in the present embodiment is performed by diversification of the intervals of increment in pulse width as in the first embodiment.

Figure 14:
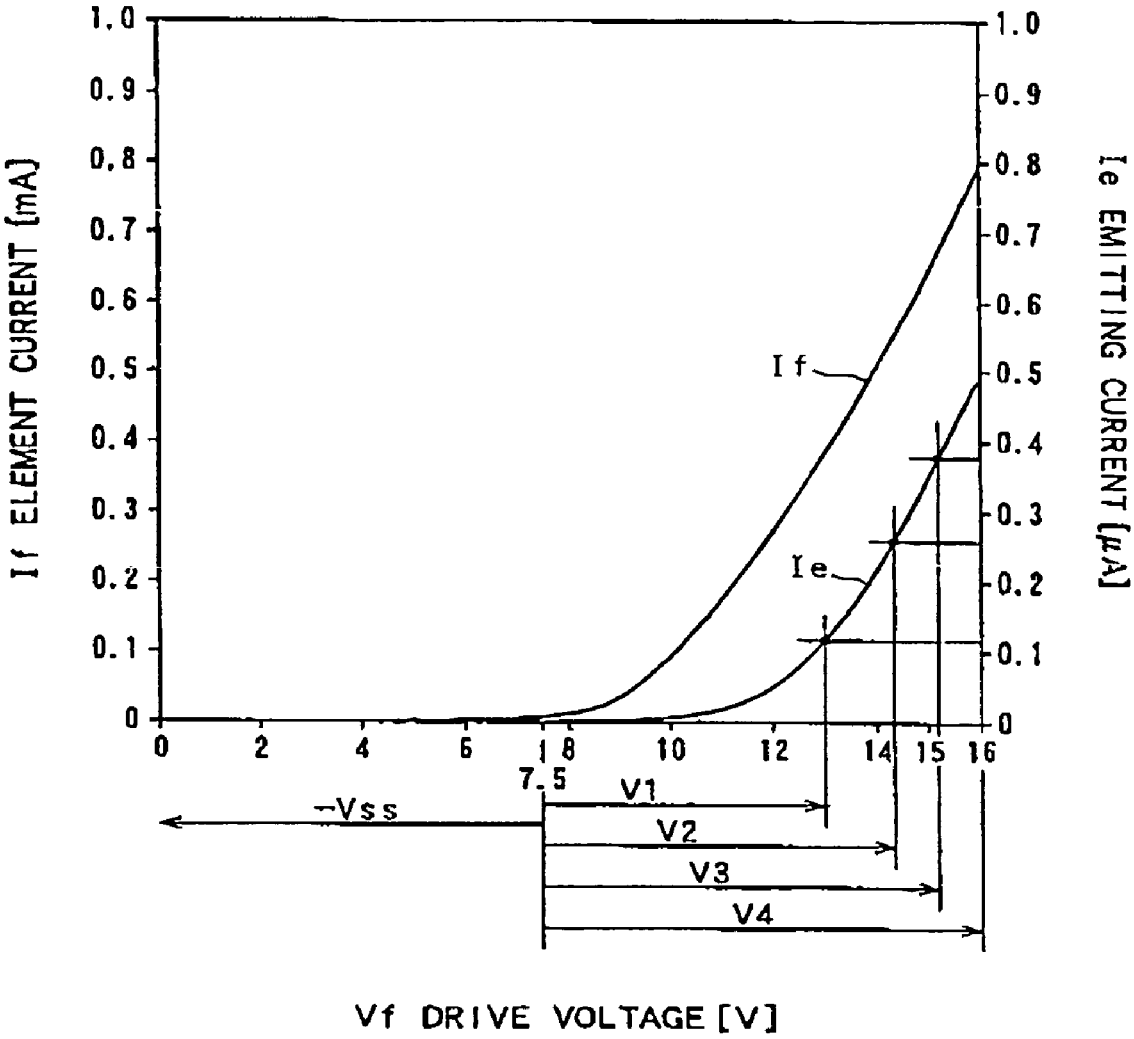
FIG. 14 is a drawing showing a characteristic of the surface conducting electron emitting element used in the invention and an example of a modulation reference voltage set in the second embodiment.

A characteristic and each voltage of the surface conducting electron emitting element used in the invention are shown in FIG. 14. Assuming that there is no saturation of fluorescent material, the intervals of the emitting current Ie (that is, brightness) determined by V1, V2, V3, and V4 as shown in FIG. 14 may be set to be equalized. It, is also preferable to measure the brightness and set the values of V1, V2, V3, and V4.

Though GND, V1, V2, V3, and V4 are employed as the modulation reference voltages, any configuration may be applied to the second embodiment of the invention as long as the crest values corresponding to at least two ON-states which are different from each other are employed. Although the configuration of voltage drive in which the potential is set to a predetermined value is disclosed as the crest value, it is not limited thereto.

The driving method of the second embodiment is the same as the first driving method.

Description will be made using a matrix panel shown in FIG. 2 used in the first embodiment.

Detailed description of FIG. 2 is omitted since it is already described in conjunction with the first embodiment.

In the second embodiment as well, high gradation is achieved by the limited total number of gradations in drive data as in the first embodiment by varying the cycle of PCLK and making the characteristic of the brightness corresponding to drive data non-linear as in the first embodiment.

Figure 15:
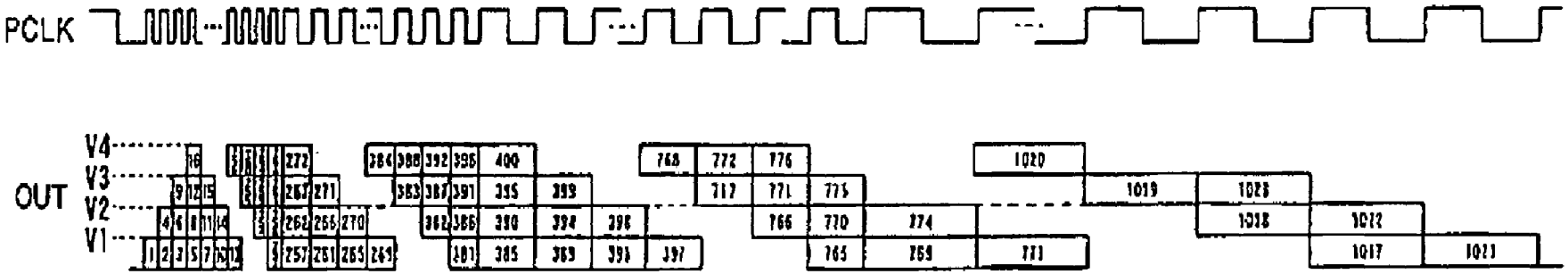
FIG. 15 is a drawing showing the waveform of the modulated signal in the second embodiment.

In FIG. 15, the waveform of the modulated signal (OUT) is shown with the slots. As in the first embodiment, the cycle of PCLK is varied. As described above, the above-described gradation characteristic for achieving preferable characteristic that human being can sense (to achieve high gradation) is realized. In other words, the brightness steps are set to be "brightness that human being can sense are regular in interval" but not "brightness step of regular intervals".

Figure 16A:
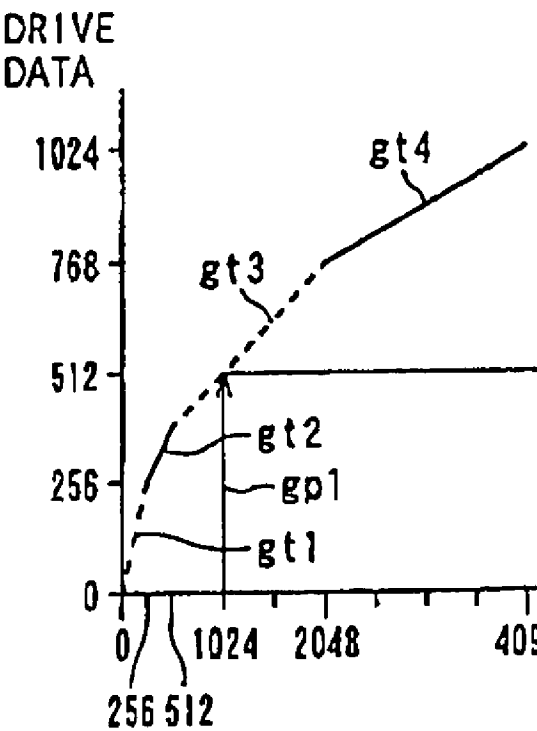
FIG. 16A is a drawing showing a characteristic of the drive data converting unit according to the second embodiment.
Figure 16B:
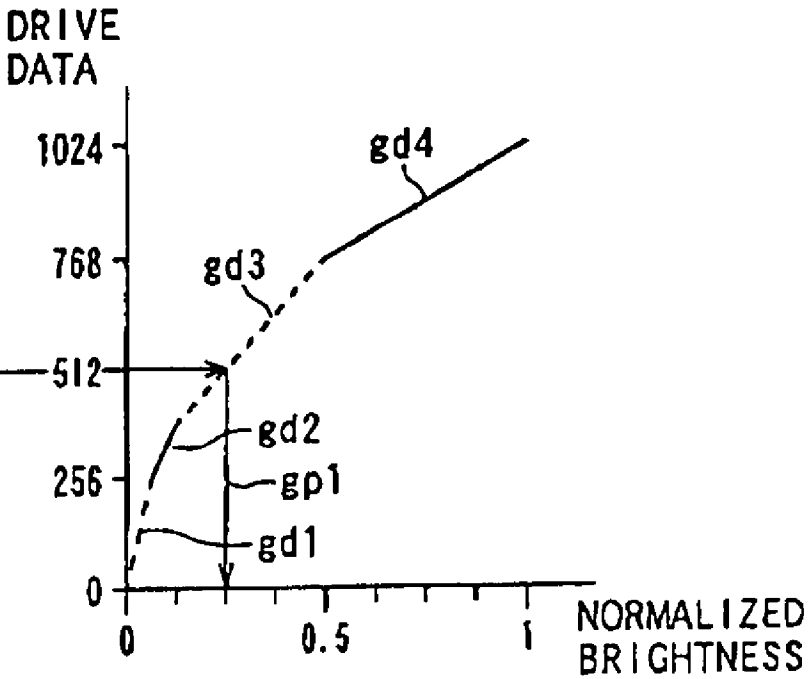
FIG. 16B is a drawing showing a brightness characteristic for drive data of the second embodiment.

A characteristic of normalized brightness with respect to incoming drive data will be shown in FIG. 16B. In FIG. 16B, the vertical axis represents incoming drive data of 10 bits in width, and the lateral axis represents the brightness.

For example, the frequencies of PCLK is selected in such a manner that the cycle of fPWM is selected for the number of PCLK from "1" to "67", half the frequency of fPWM is selected for the number of PCLK from "68" to "129", a quarter the frequency of fPWM is selected for the number of PCLK from "130" to "225", and eight part the frequency of fPWM is selected to the number of PCLK from "226" to "258".

Since the frequency of PCLK is high in drive data from "0" to approximately "255" as shown in FIG. 16B, the brightness at this time is shown in such a manner that increment of brightness is small with respect to drive data, and hence inclination in the graph is significant (straight line gd1). The characteristics of drive data from approximately "255" to approximately "383" is represented by the straight line gd2, drive data from approximately "383" to approximately "767" by the straight line gd3, and drive data from approximately "767" to approximately "1023" by the straight line gd4, respectively.

The reason why the numerals are added with "approximately, as is clear from the sizes of the slot shown in FIG. 15, the area of each block (the magnitude of the area corresponds to the magnitude of drive energy) is not uniform, and hence increment in brightness varies in erratic pattern with respect to increment of the drive data when switching the PCLK.

Figure 17:
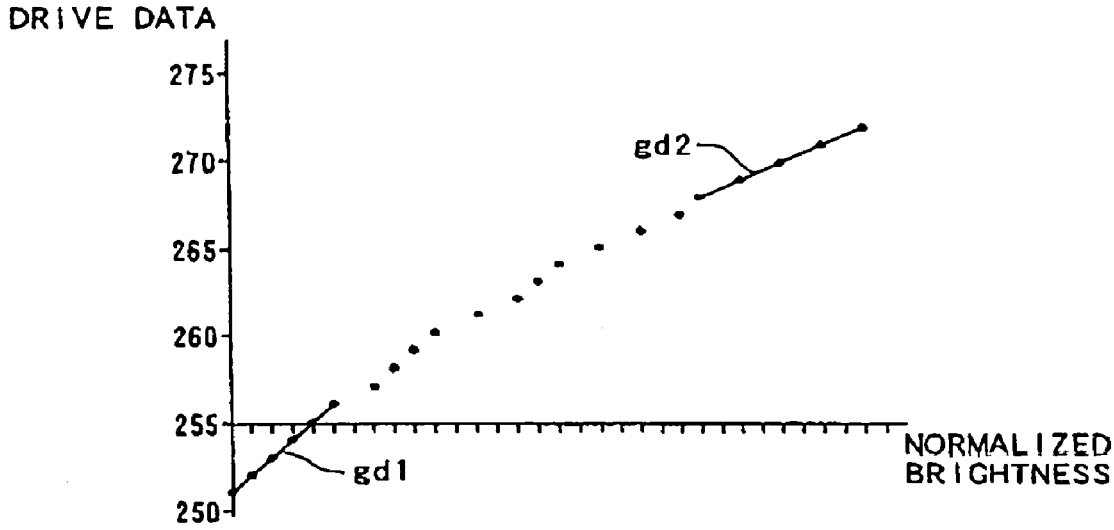
FIG. 17 is an partly enlarged drawing showing the brightness characteristic for drive data of the second embodiment.

FIG. 17 is a drawing for providing easy comprehension of increment in brightness with respect to increment in drive data. In FIG. 17, as in FIG. 16B, the vertical axis represents incoming drive data, and the lateral axis represents the brightness. An enlarged drawing near the drive data "256" is shown. It will be seen that increment in brightness actually varies in erratic pattern with respect to increment in drive data. A characteristic of the drive data converting unit that will be described later is preferably be determined while taking the characteristic shown in FIG. 17 into account.

With the change of the driving condition described above, the characteristic which is substantially similar to the visual characteristic of human being is achieved. It is also effective to reduce the sorts of frequencies of PCLK for simplifying the hardware configuration as a matter of course. It is further preferable to make the cycle of PCLK continuously variable by the use of ROM or VCO. Since the configuration disclosed in JP-A-2000-29425 can be employed as an actual hardware configuration for realizing the PCLK of uneven cycle, description will be omitted here.

This embodiment is also characterized in that brightness data having a desirable characteristic, for example, a linear characteristic, is converted into drive data, and the driving conditions (cycle of PCLK) are determined so as to improve gradation in the range of low gradations. Preferably, the desirable characteristic is the linear characteristic in the case of color processing.

Subsequently, a characteristic of the drive data converting unit for converting brightness data having, for example, the brightness-linear characteristic as the desirable characteristic into drive data is shown in FIG. 16A. In FIG. 16A, the lateral axis represents incoming brightness data of 12 bits in width, and the vertical axis represents converted drive data of 10 bits in width. Since incoming brightness data has a linear characteristic (data indicating the brightness that the value of data should indicate), in FIG. 16A, the characteristic of the drive data converting unit is determined in such a manner that incoming brightness data is converted into drive data, and further, brightness modulated by drive data and then displayed is accordingly proportional to brightness data. In other words, conversion is determined so that drive data falls within the range from "0" to "255" for brightness data in the range from "0" to "255" (straight line of gt1). It is determined so that drive data falls within the range from "255" to "383" for brightness data in the range from "255" to "511" (straight line of gt2). It is determined so that drive data falls within the range from "383" to "767" for brightness data in the range from "511" to "2047" (straight line of gt3). Then, it is determined so that drive data falls within the range from "767" to "1023" for brightness data in the range from "2047" to "4095" (straight line gt4). Preferably, the table is set so that the value in which variations described above are corrected are outputted in the vicinity of the inflection point of the characteristic of the drive data converting unit.

Based on the description above, the operation in a case in which brightness data "1024", for example (brightness is a quarter the full range) is supplied will be described. Brightness data "1024" is converted in the drive data converting unit into drive data "512" (gp1). Drive data "512" is supplied into the width modulator, and the normalized brightness 0.25 is outputted (gp2). Therefore, brightness corresponding to brightness data can be obtained. As seen in FIG. 16A and FIG. 16B, even with the modulation of drive data of 10 bits gradation, the number of gradations corresponding to 12 bits, 11 bits, 10 bits, and 9 bits in brightness data conversion of the linear characteristic from the low brightness in sequence is realized.

Figure 18:
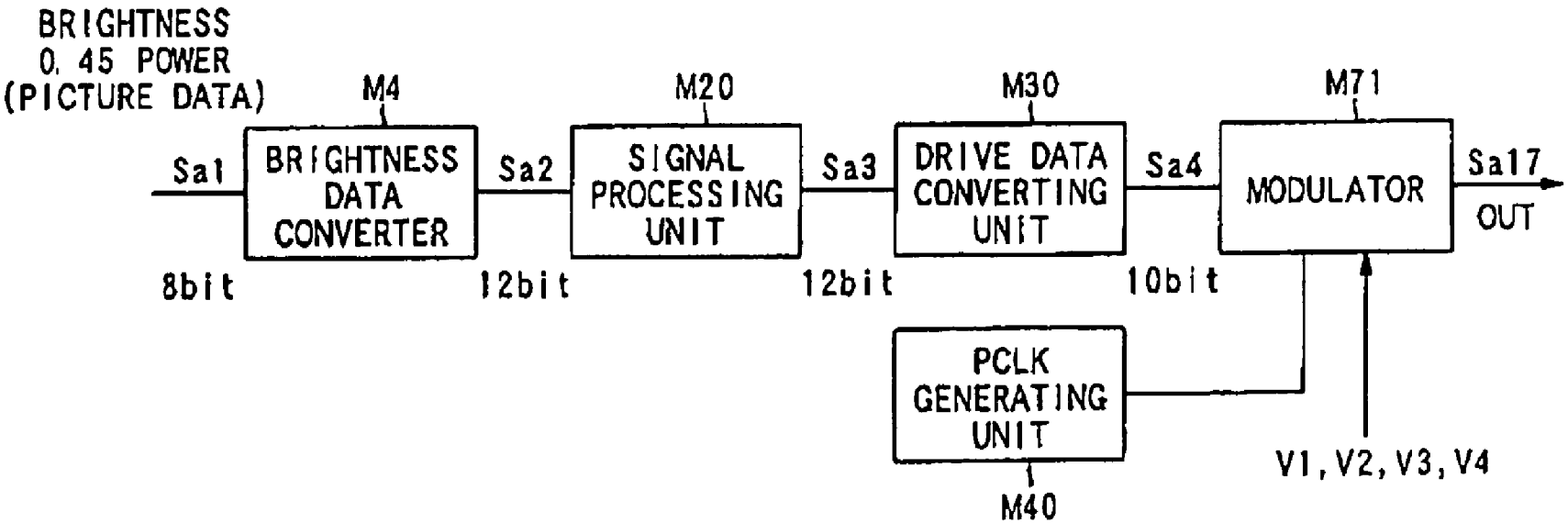
FIG. 18 is an explanatory block diagram showing the basic configuration of the second embodiment.

FIG. 18 is an explanatory block diagram showing the basic configuration of the driving method according to the present embodiment. In FIG. 18, reference sign M71 designates a modulator which is for supplying the modulation reference voltages GND, V1, V2, V3, and V4 and outputs the modulated signals described above. Since other configurations are the same as those in the first embodiment, description will be omitted.

As in the first embodiment, the brightness data converter M4 converts digital picture data (Sa1) which is gamma-converted, as the TV signal, and then into image data (Sa2) having the linear characteristic. Signal processing such as color adjustment is performed on converted image data (Sa2) in the signal processing unit M20. The signal processing unit M20 outputs brightness data (Sa3) which is the result of performing signal processing. The drive data converting unit M30 converts incoming brightness data (Sa3) into drive data (Sa4). In this conversion, conversion is performed in such a manner that the total number of gradations in outputted drive data (Sa4) is smaller than the total number of gradations in incoming brightness data (Sa3). For example, in this embodiment, the bit width of brightness data. (Sa3) is determined to be 12 bits (4096 gradations), and the bit width of drive data is determined to be 10 bits (1024 gradations).

Therefore, high gradation is achieved with the small number of gradations of drive data as described above.

Since the entire configuration of the second embodiment of the invention is the same as the configuration according to the first embodiment described above (FIG. 8), description will be omitted. Since the timing is the same other than the shape of the drive signal (S17), illustration in the drawing is omitted. However, the frequency of PCLK in the second embodiment is about a quarter in comparison with the first embodiment, and hence achievement of hardware configuration can easily be made.

In the second embodiment of the invention as well, the drive circuit 7 which performs the modulation with drive data of 10 bits in width can achieve display with brightness resolution corresponding to the 12 bits gradation having a linear characteristic in the range of low brightness.

Then, a high gradation is achieved with the small number of brightness steps utilizing the characteristic of the human sense. When compared with a general modulation having a linear characteristic, a characteristic corresponding to the modulation of about 12 bits in width can be obtained with the 10-bit width modulator. In the matrix panel having a large number of pixels, manufacturing cost for the drive circuit, especially the modulation circuit is high, and hence the invention in which a high gradation can be achieved with the small number of drive data width (the bit width of the modulator can be reduced even with the total number of gradations which is recognized as the same) is suitable for cost reduction.

In addition, the method of the invention can cope with signal processing of color adjustment or signal processing for correcting the effect of voltage drop in the row wirings.

Third Embodiment

A third embodiment of the invention will be described. In the first place, the basic operation of the driving method according to the third embodiment of the invention will be described. As in the first embodiment, the basic operation will be described referring to the matrix panel shown in FIG. 2. Description of the components in FIG. 2 and the general driving method are omitted.

In the third embodiment, a modulating method different from the first embodiment and the second embodiment is employed. A method of modulating the column wirings will be described. The method of modulating according to the third embodiment of the invention is a modulating method in which the pulse width modulation (PWM) and the crest value modulation are combined as in the second embodiment.

However, while the second embodiment employs the crest value modulation preference type combined modulation, the third embodiment employs a pulse width modulation preference type combined modulation.

Figure 19A:
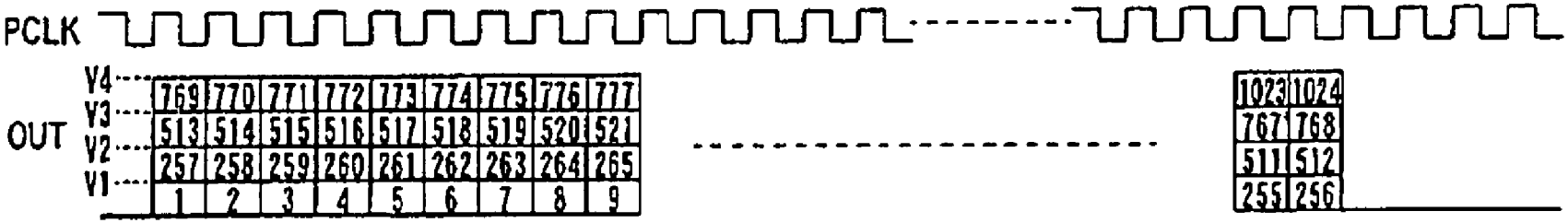
FIG. 19A is a drawing showing a waveform of a modulated signal used in a third embodiment.

An example of the waveform of an outgoing modulated signal is shown in FIG. 19A.

FIG. 19A shows the PCLK and the waveform of the modulated signal (OUT). The numerals (1–1024) in the rectangular box of the waveform of the signal means drive data, and when drive data is, for example, "9", the waveform of the modulated signal is those having numerals smaller than "9" in the rectangular box. The rectangular box is referred also to as block for convenience. The crest value of each slot is determined synchronously with the rising waveform of PCLK, which is the reference clock.

Control of such modulated signal can be expressed as such control that enumeration is performed by the reference clock and pulse width control is performed by the unit of slot width Δt based on the enumerated value and drive data, crest value control is performed on the crest value at each slot at least in n-stages from A1 to An (where n is an integer number equal to or larger than two, and 0<A1<A2 . . . An), and the waveform which is increased in gradation with respect to the predetermined waveform of the modulated signal has such shape that a unit waveform block which is determined by the slot width and the crest value An−An−1, . . . or A2−A1, or the difference in crest value between the crest value A1 and the crest value which is a drive threshold of the light-emitting element and the slot width Δt is added to a point where the maximum crest value Ak including k=1 is lower and the maximum crest values continue by priority. Here the modulated signal is a voltage waveform, and the voltage is composed of crest values of four stages from V1 to V4.

Figure 20:
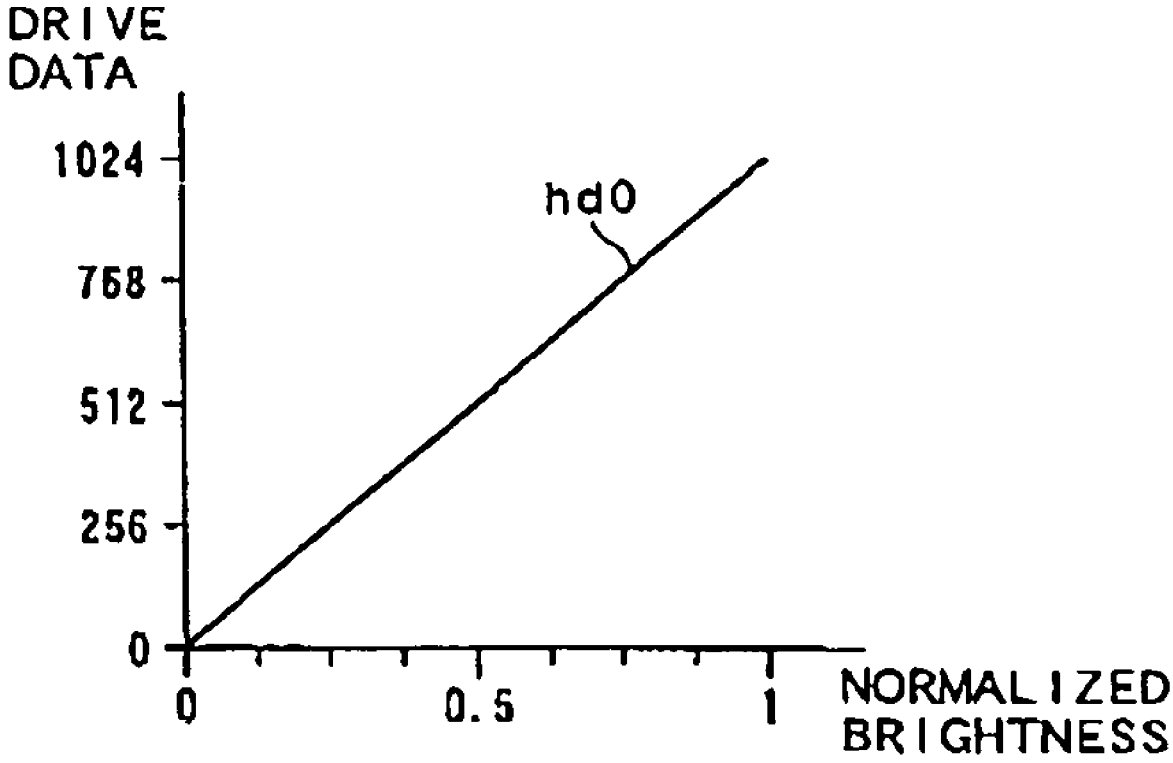
FIG. 20 is a drawing showing a brightness characteristic for drive data according to an example of the waveform of the modulated signal used in the third embodiment.

FIG. 20 shows an example of the characteristic of normalized brightness with respect to incoming drive data. In FIG. 20, the vertical axis represents incoming drive data, and the lateral axis represents the brightness. More accurately, although the brightness becomes discrete for discrete drive data, the characteristic is represented by a solid straight line (hd0). Shown in FIG. 20 is an example in which a linear characteristic is achieved by selecting a voltage (modulation reference voltage: GND, V1, V2, V3, and V4). In the same manner as the second embodiment, when V1, V2, V3, and V4 shown in FIG. 14 are used, a linear characteristic is achieved.

In the present embodiment in which the pulse width modulation preference type combined modulation is employed, the above-described setting is not employed. Alternatively, these crest values are set by differentiating increment in brightness (brightness steps) when the crest value of the slot of a predetermined width is increased from GND to V1, increment in brightness (brightness steps) when the crest value of the slot of the predetermined width is increased from V1 to V2, increment in brightness (brightness steps) when the crest value of the slot of the predetermined width is increased from V2 to V3, and increment in brightness (brightness steps) when the crest value of the predetermined width is increased from V3 to V4 as drive data increases one from a certain value, not by equalizing these increments.

In particular, the brightness steps at a crest value corresponding to the range of low gradations, which requires visually small brightness steps in terms of visual sense of human being, is set to be small. More specifically, the brightness steps at the crest value V1 corresponding to the range of low gradations is set to be smaller than the brightness steps in the crest value V4 corresponding to the range of high gradations.

Figure 21:
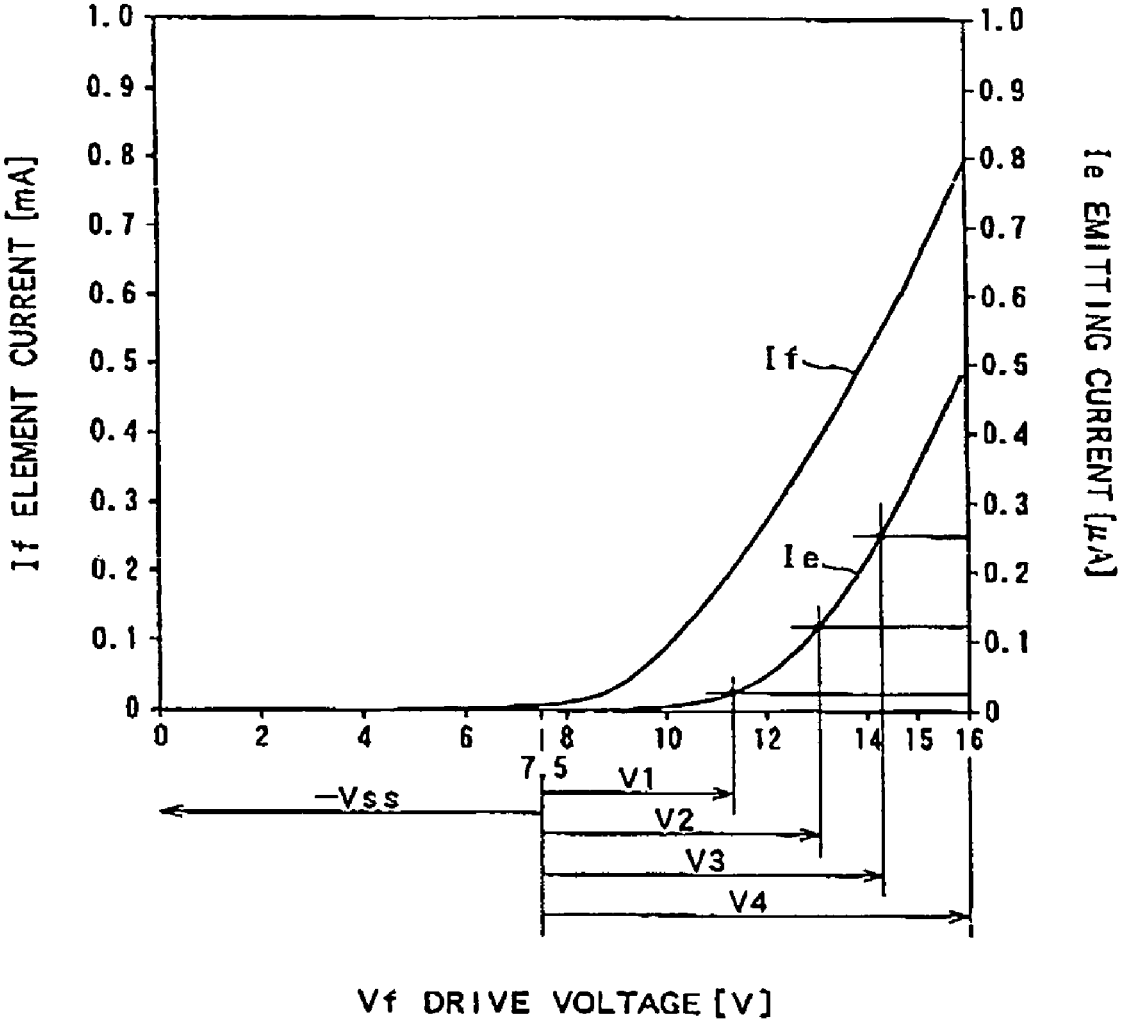
FIG. 21 is a drawing showing a characteristic of the surface conducting emitting element used in the invention and an example of a modulation reference voltage set in the third embodiment.

A characteristic and each voltage of the surface conducting electron emitting element used in the third embodiment of the invention are shown in FIG. 21. Assuming that there is no saturation of fluorescent material, the intervals of the emitting current Ie (that is, brightness) determined by V1, V2, V3, and V4 as shown in FIG. 21 are selected as:

V1: 1/16 of the brightness of V4

V2: 1/4 of the brightness of V4

V3: 1/2 of the brightness of V4 when driven by the same pulse width for the brightness driven by the voltage V4.

Figure 22A:
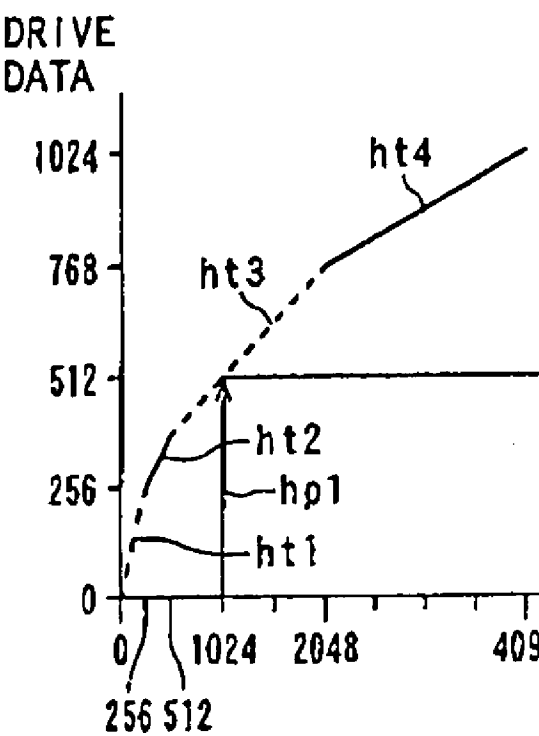
FIG. 22A is a drawing showing a characteristic of the drive data converting unit of the third embodiment.
Figure 22B:
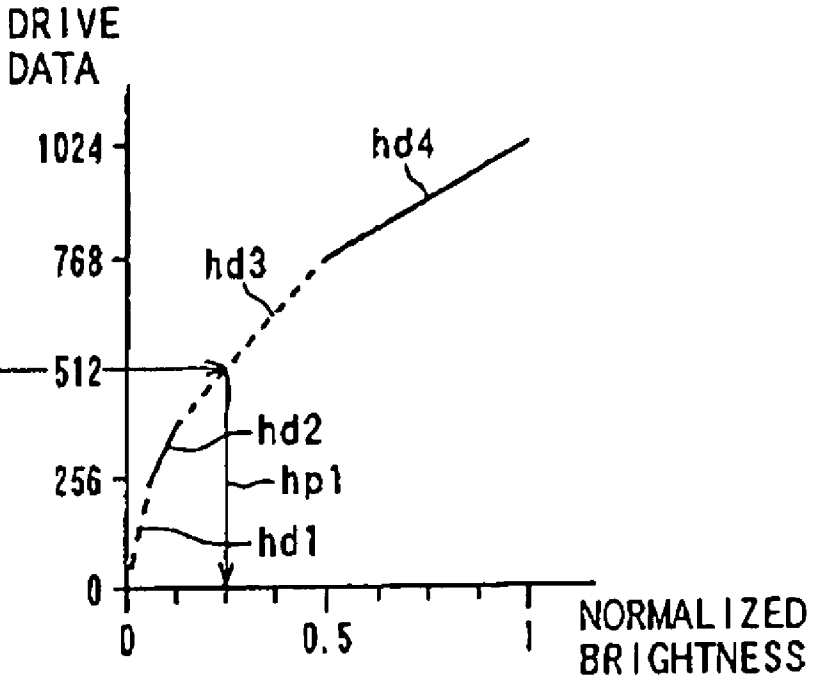
FIG. 22B is a drawing showing a brightness characteristic for drive data of the third embodiment.

FIG. 22B shows a characteristic of the normalized brightness with respect to incoming drive data. It was also preferable when the brightness was measured and V1, V2, V3, and V4 are set to achieve a desired characteristic.

Though GND, V1, V2, V3, and V4 are employed as the modulation reference voltages in the present embodiment, any configuration may be applied to the third embodiment of the invention as long as the crest values corresponding to at least two ON-states which are different from each other are employed. A high gradation is achieved when the modulation reference voltage is selected so as to achieve a resolution of low gradation. In other words, by setting to such voltage value that the number of gradations in the range of low brightness increase, more specifically, by setting the voltages of V1, V2, and V3 to such voltages that the brightness decreases with respect to the linear characteristic, the obtained curve of the characteristic has an effect to improve the gradations also in cases other than that shown in the present embodiment.

In the third embodiment, the cycle of PCLK is not varied unlike the case of the first and the second embodiments. Therefore, it is a method in which a problem such as the limit of the operational frequency of the semiconductor due to increase in frequency of PCLK can hardly occur. In the third embodiment, by determining the modulation reference voltages GND, V1, V2, V3, and V4 as described above, the non-linear characteristic of the brightness corresponding to drive data is achieved, and a high gradation is achieved by the limited total number of gradations in drive data as in the first and second embodiments.

In the present embodiment, the value of the modulation reference voltages GND, V1, V2, V3, and V4 are varied from the linear characteristic. Then, the gradation characteristic for achieving desirable characteristic that human being can sense (for achieving the high gradation) as described above. That is, the "brightness step of regular intervals" is changed to such brightness step that "the differences in brightness that human being can sense are regular in interval".

FIG. 22B shows a characteristic of the normalized brightness with respect to the incoming drive data. In FIG. 22B, the vertical axis represents incoming drive data, and the lateral axis represents the brightness.

As described above, when the modulation reference voltages GND, V1, V2, V3, and V4 are selected, the brightness at that time is, as shown in FIG. 22B, small in increment with respect to the drive data and hence inclination on the graph is significant (straight line hd1) for drive data from "0" to "256". The characteristics of drive data from "256" to "512" is represented by the straight line hd2, drive data from "512" to "768" by the straight line hd3, and drive data from "768" to "1024" by the straight line hd4.

With the change in driving conditions as described above, the characteristic that is close to the visual characteristic of human being is achieved. When the number of sorts of the modulation reference voltages GND, V1, V2, V3, and V4 is reduced for simplifying the configuration of the hardware, it is still effective as described above.

This embodiment is characterized in that brightness data of the desired characteristic, for example, of the linear characteristic is converted into drive data, and the driving conditions (modulation reference voltages GND, V1, V2, V3, and V4) are determined so that the intervals of brightness that human being senses with respect to drive data becomes closer to the regular interval. Preferably, the desired characteristic for color processing is the linear characteristic.

Subsequently, a characteristic of the drive data converting unit for converting brightness data having, for example, the brightness-linear characteristic as the desired characteristic into drive data is shown in FIG. 22A. In FIG. 22A, the lateral axis represents incoming brightness data of 12 bits in width, and the vertical axis represents converted drive data. Since incoming brightness data has a linear characteristic here, in FIG. 22A, the characteristic of the drive data converting unit is determined in such a manner that incoming brightness data is converted into drive data, and further, the brightness modulated by drive data and then displayed is accordingly proportional to brightness data.

In other words, conversion is determined so that drive data falls within the range from "0" to "256" for brightness data in the range from "0" to "256" (straight line of ht1). It is determined so that drive data falls within the range from "257" to "512" for brightness data in the range from "257" to "1024" (straight line of ht2).

It is determined so that drive data falls within the range from "513" to "768" for brightness data in the range from "1025" to "2048." (straight line of ht3). Then, it is determined so that drive data falls within the range from "769" to "1023" for brightness data in the range from "2049" to "4095" (straight line ht4). In this case, the lateral axis represents incoming brightness data of 12 bits in width. Assuming that drive data is 10 bits in width, brightness data "4096" and drive data 1024" do not exist.

Based on the description above, the operation in a case in which brightness data "1024", for example (brightness is a quarter the full range) is supplied will be described. Brightness data "1024" is converted in the drive data converting unit into drive data "512" (hp1). Drive data "512" is supplied into the pulse width modulator, and the normalized brightness 0.25 is outputted (hp2). Therefore, brightness corresponding to brightness data can be obtained. As seen in FIG. 22A and FIG. 22B, even with the modulation of drive data of 10 bits in width, equivalent to the number of gradations corresponding in sequence to 12 bits, 11 bits, 10 bits, and 9 bits in brightness data conversion of the linear characteristic from the low brightness on is realized as in the first and second embodiments.

Figure 23:
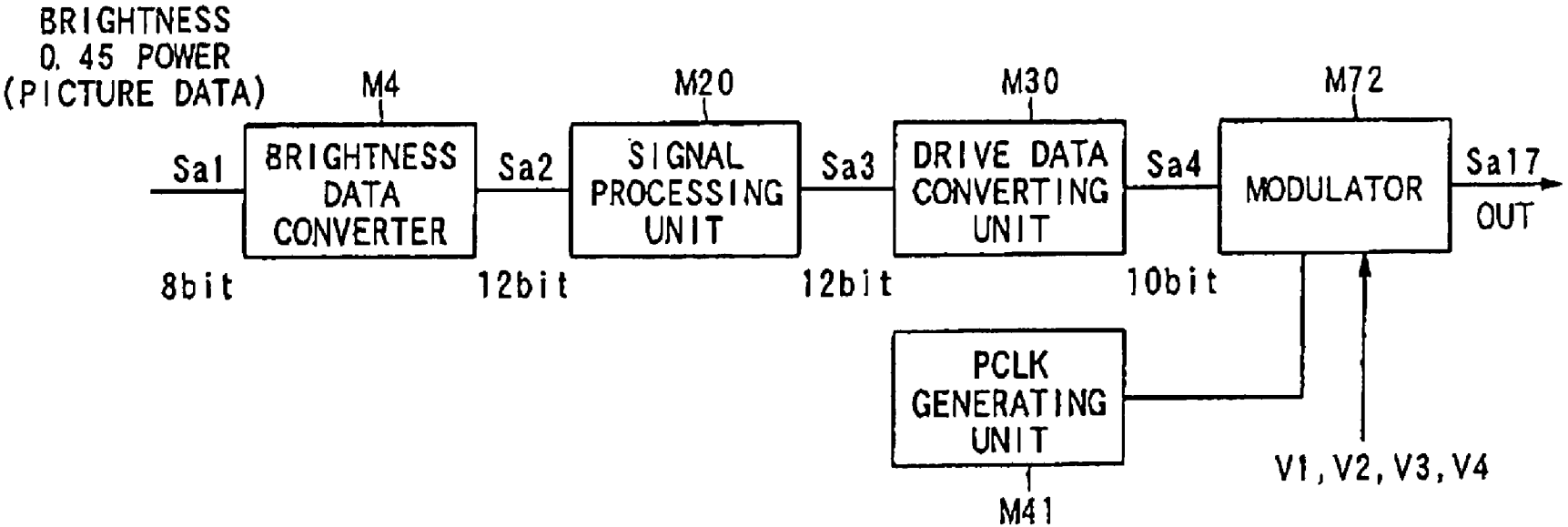
FIG. 23 is an explanatory block diagram showing the basic configuration of the third embodiment.

FIG. 23 is an explanatory block diagram showing the basic configuration of the driving method according to the invention. In FIG. 23, reference sign M72 designates a modulator, which is for supplying the modulation reference voltages: GND, V1, V2, V3, and V4 and outputs the modulated signals described above. Reference sign M41 designates a CLK generating unit, and in the third embodiment, the PCLK of a fixed frequency is generated. Since other components are the same as the first embodiment, description will be omitted.

As in the first embodiment, the brightness data converter M4 converts digital picture data (Sa1) which is gamma-converted, as the TV signal, and then into image data (Sa2) having the linear characteristic. Signal processing such as color adjustment is performed on converted image data (Sa2) in the signal processing unit M20. The signal processing unit M20 outputs brightness data (Sa3) having a linear characteristic which is the result of performing signal processing. The drive data converting unit M30 converts incoming brightness data (Sa3) into drive data (Sa4). In this conversion, conversion is performed in such a manner that the total number of gradations in outputted drive data (Sa4) is smaller than the total number of gradations in incoming brightness data (Sa3). For example, in this embodiment, the bit width of brightness data (Sa3) is determined to be 12 bits (4096 gradations), and the bit width of drive data is determined to be 10 bits (1024 gradations).

Therefore, high gradation is achieved with the small number of gradations as described above.

Figure 24:
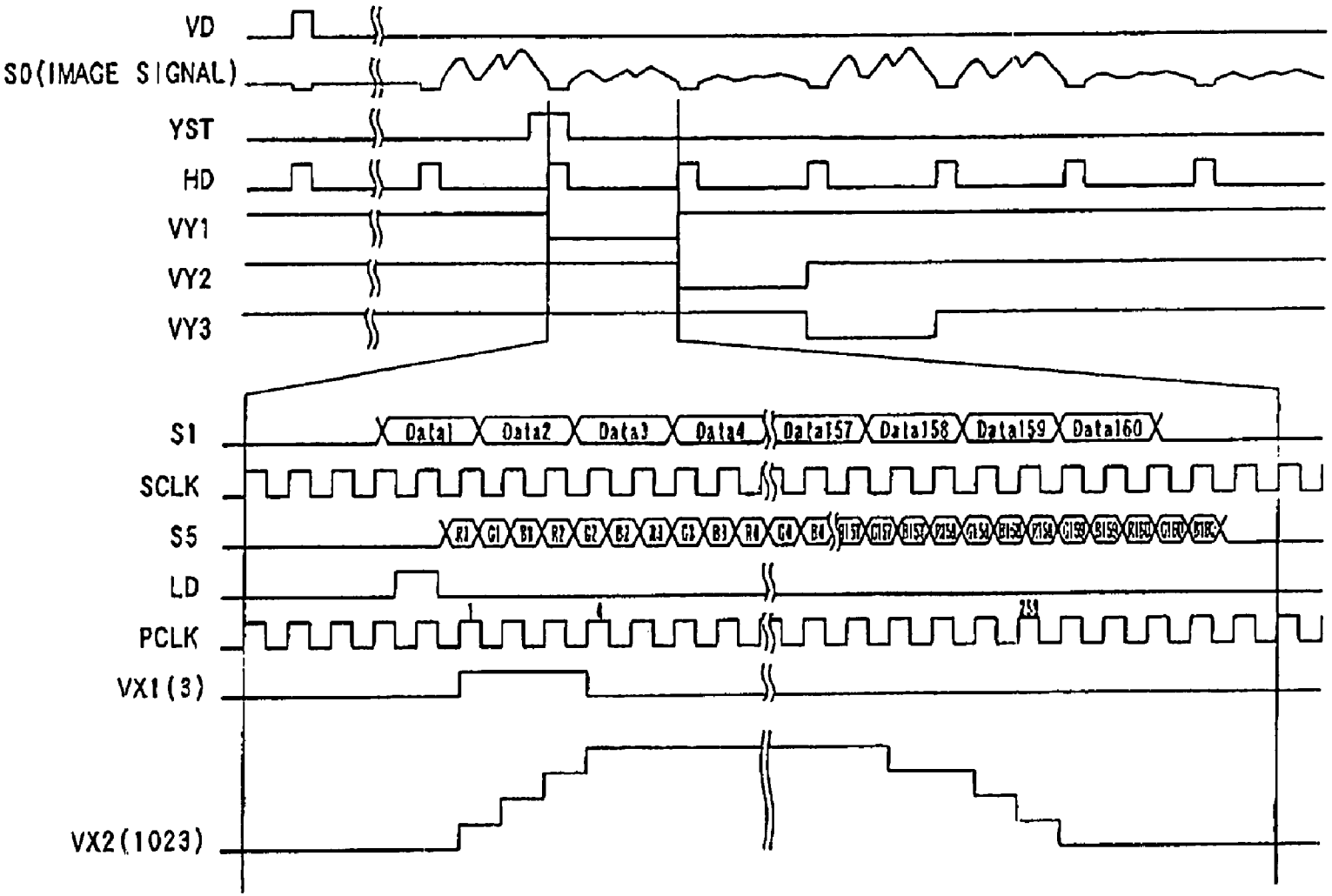
FIG. 24 is a timing diagram of a drive circuit according to the third embodiment.

Since the entire configuration of the third embodiment of the invention is the same as the configuration of the above-described first embodiment (FIG. 8) other than the drive circuit 7, description will be omitted. The timing is shown in FIG. 24. In the timing chart as well, since the timing is the same as the first embodiment other than the PCLK and the shape of the drive signals VX1, VX2 . . . (S17), illustration in the drawing is omitted.

Figure 19B:
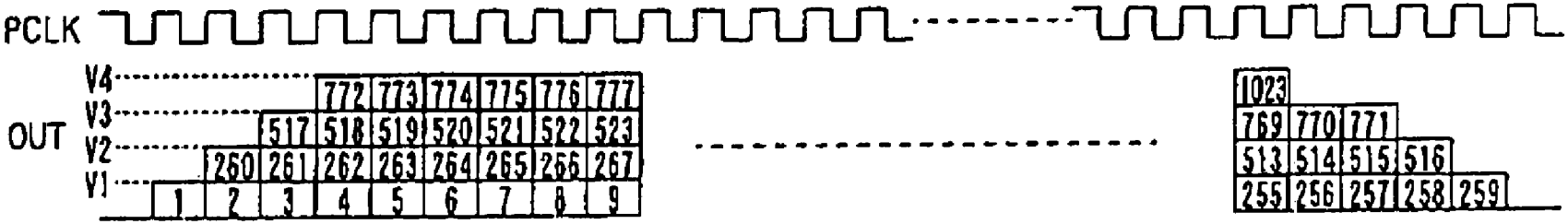
FIG. 19B is a drawing showing the waveform of a signal of other modulation system used in the third embodiment.

FIG. 19B shows another example of the modulating method according to the third embodiment. Basically, as described above, the pulse width modulation preference type combined modulation is employed, in which the reference clock (referred to as PCLK) is enumerated and the pulse width and the crest value corresponding to drive data are determined. This method is a modulating method in which the waveform of the modulating signal is extended in the direction of time, and when it cannot be extended anymore, the waveform is widened in the direction of crest value. In another example of the modulating method according to the third embodiment, the rising and falling waveforms of the modulated signal are controlled to be a stepped shape in order to reduce ringing of the drive waveform in the matrix panel. In addition to the case shown in FIG. 19A, such waveform control of the modulated signal can be said to be control in which the waveform further increased by one gradation by adding the unit waveform block to the waveform with the maximum crest value Ak and having the number of slots of S−2(k−1), where the maximum number of slots is S, can be controlled to be a waveform having such shape that the crest value of the given slot out of the $k+1^{st}$ to the $S-k^{th}$ slots is changed from Ak to Ak+1. In this case, the value S is 259. In other words, in this example, such condition that the range of pulse widths available in the predetermined crest value as set to a value smaller than the range of pulse widths available in the crest value smaller than the predetermined crest value so that the rising and/or falling portion of the waveform of the modulated signal has a stepped shape without setting the range of the pulse widths available in each crest value to the same range can be preferably employed.

As described above in the present embodiment, the modulation reference values: GND, V1, V2, V3, and V4 are set.

However, since the drive waveform is different from the above-described modulated signal, the following setting was further preferable.

In other words, brightness data is set to 12 bits in width, and drive data is set to 10 bits in width. Then drive data is determined to fall within the range from "0" to "259" for brightness data from "0" to "259". That is, the proportion of brightness data and drive data are set to 1:1. Drive data is determined to fall within the range from "260" to "516" for the brightness data from "260" to "1030". In other words, "259" is subtracted from the brightness data, and then divided by 3, added by "259" to obtain drive data. Drive data is determined to fall within the range from "517" to "771" for brightness data "1031" to "2050". In other words, "1030" is subtracted from brightness data, divided by 4, and then added by "516" to obtain drive data. Then, drive data is determined to fall within the range from "772" to "1023" for brightness data from "2051" to "4095". In other words, "2050" is subtracted from brightness data, then divided by 8.11, and added by "711" to obtain drive data. Then, drive data is determined to fall within the drive data is determined to fall within range from "772" to "1023" for brightness data of "2051" to "4073". That is, "2050" is subtracted from brightness data, then divided by 8, and added by "771" to obtain drive data. Even when brightness data of 4074 or higher is controlled, the quality of image is little affected. Since division can be made by bit shift calculation, hardware can be prepared by a logic circuit without using the ROM or the like, and hence the cost for the circuit can be reduced. Such conversion process in the brightness data converter M4 can be made by the ROM table as a matter of course.

More accurately, the modulation reference voltages of: GND, V1, V2, V3, and V4 are preferably set at a normalized brightness, as follows.

when drive data is "259", 259/4096,
when drive data is "516", 1030/4096
when drive data is "771", 2050/4096
when drive data is 1023, 4095/4096

In the third embodiment of the invention as well, the drive circuit 7 which performs the modulation with data of 10 bits in width can achieve display with brightness resolution corresponding to the 12 bits gradation having a linear characteristic in the range of low brightness.

Then, a high gradation is achieved with the small number of brightness steps utilizing the characteristic of the human sense. When compared with a general modulation having a linear characteristic, a characteristic corresponding to the pulse width modulation of about 12 bits can be obtained with the 10 bits width modulator. In the matrix panel having a large number of pixels, manufacturing cost for the drive circuit, especially the modulation circuit is high, and hence the invention in which a high gradation can be achieved with the small number of drive data width (the bit width of the modulator can be reduced even with the total number of gradations which is recognized as the same) is suitable for cost reduction.

In addition, the method of the invention can cope with signal processing of color adjustment or signal processing for correcting the effect of voltage drop in the row wirings.

Other Embodiment

The invention is characterized in that display recognized as a high gradation is achieved with the small total number of graduations in drive data utilizing the human sense by changing the driving conditions (PCLK, modulation reference voltage) so as to achieve the non-linear brightness with respect to incoming drive data into the modulator. In other words, it is characterized in that display to be recognized as a high gradation is achieved by the small total number of gradations in drive data utilizing the characteristic of the human sense by changing the driving conditions (PCLK, modulation reference voltage), and hence changing driving energy (driving amount) to be supplied to the display elements to achieve the non-linear brightness with respect to incoming drive data into the modulator. Therefore, the invention can be applied to other modulating method to bring about the effect. Then, brightness data, which is the desired characteristics (in particular, linear characteristic) is converted into drive data by the drive data converting unit to achieve the desired characteristics (in particular, linear characteristic) between brightness data and the brightness. In addition, the total number of gradations in drive data can be reduced by the total number of gradation in brightness data.

Linear brightness data is preferable for signal processing such as color adjustment, and in the invention in which the bit width is increased, calculation with high degree of accuracy is enabled. As described above, signal processing may be other types of processing.

In the second embodiment or in the third embodiment, as in the first embodiment, it is also preferable to perform processing such as the brightness adjustment (adding of offset) on drive data (Sa4) which is the output of the drive data converting unit M30 as needed, and output to the modulators M71, M72.

While the configuration of the cold cathode electron emitting elements in the invention has been described, other various electron emitting elements such as the surface conducting emitting element, FE type emitting element, or MIM type emitting element can be used. In addition to the electron emitting elements, various image display elements such as EL element which performs simple matrix drive can also be employed.

According to the invention, preferable display is achieved.

What is claimed is:

1. An image display apparatus comprising;

display elements, the display elements performing brightness gradation display by being applied with a modulated signal;

a modulation circuit for generating a modulated signal modulated based on incoming drive data; and a clock supplying circuit for supplying a reference clock whereof the frequency changes at a predetermined cycle for controlling a pulse width of the modulated signal or at least one of the pulse width and a crest value transition to the modulation circuit, wherein the modulation circuit generates such modulated signal that the difference in display brightness generated when making the display elements display by two modulated signals obtained based on the drive data having one gradation difference in a first range of gradations, which is part of an entire range of gradations of the incoming drive data, becomes smaller than the difference in display brightness in a second range of gradations, which is different from the first range of gradations, wherein the modulation circuit enumerates the reference clock and controls the pulse width of the modulated signal or at least one of the pulse width and the crest value transition based on the enumerated value and the drive data, and wherein a drive data converting unit for converting incoming data and outputting output signals as the drive data is provided in a previous stage of the modulation circuit, and the total number of gradations of the signals outputted from the drive data converting unit is smaller than the total number of gradations in data to be supplied into the drive data converting unit.

2. An image display apparatus according to claim 1, further comprising a signal processing circuit in a previous stage of the drive converting unit, wherein a signal processed by the signal processing circuit is supplied into the drive data converting unit.

3. An image display apparatus according to claim 2, wherein the signal processing circuit performs a color adjustment process for the signal supplied into the signal processing circuit.

4. An image display apparatus according to claim 2, wherein the signal processing circuit corrects a signal, which is supplied into the signal processing circuit and which corresponds to a predetermined display element out of the plurality of display elements, the signal being corrected based on the signals corresponding to other display elements.

5. An image display apparatus according to claim 2, wherein the drive data converting unit outputs incoming data after having converted so that a desired relation is achieved between incoming data and display brightness.

6. An image display apparatus according to claim 5, wherein the drive data converting unit converts incoming data so as to achieve a display at a brightness instructed by incoming data.

7. An image display apparatus according to claim 2, further comprising a non-linear converting unit in a previous stage of the signal processing circuit, wherein the non-linear converting unit performs non-linear conversion for moderating non-linear conversion of a signal to be supplied into the non-linear conversion unit performed by a sender of the signal in order to obtain the signal.

8. An image display apparatus according to claim 1, wherein the modulation circuit enumerates the reference clock and controls the pulse width of the modulated signal based on the enumerated value and the drive data, and the frequency of the reference clock in an area where the enumerated value is small differs from that in an area where the enumerated value is large.

9. An image display apparatus according to claim 8, wherein the modulation circuit performs a crest value modulation preference type combined modulation, which is the combination of the pulse width modulation and the crest value modulation based on the incoming drive data.

10. An image display apparatus according to claim 1, wherein the modulation circuit enumerates the reference clock and controls the pulse width of the modulated signal based on the enumerated value and the drive data, performs the crest value modulation preference type combined modulation, which is the combination of the pulse width modulation in which the pulse width is controlled and the crest value modulation for selecting at least two crest values, which bring the display elements into the different ON-states, and outputs the modulated signal to make the crest value vary in stages, wherein the frequency of the reference clock is switched in stages, and wherein the modulation circuit further includes a drive data converting unit for correcting variations in gradation caused by the fact that a portion where the crest value of the modulated signal changes in stages positions before and after the portion at which the frequency of the reference clock is switched.

11. An image display apparatus according to claim 1, wherein the display element is a cold cathode element.

12. An image display apparatus according to claim 1, wherein the display elements are interconnected into a matrix by a plurality of row wirings and column wirings, wherein a row selecting circuit for selecting at least one row wiring out of the plurality of row wirings for a predetermined selection period is provided, and wherein the modulation circuit supplies a modulated signal based on the drive data to the plurality of row wirings synchronously with the selection period.

13. An image forming apparatus according to claim 1, further comprising:

a signal processing circuit provided in a previous stage of the drive data conversion unit; and a non-linear conversion unit provided in a previous stage of the signal processing circuit, wherein the non-linear converting unit performs non-linear conversion for moderating non-linear conversion of a signal to be supplied into the non-linear conversion unit performed by a sender of the signal in order to obtain the signal.

14. An image display apparatus, comprising:

display elements, the display elements performing brightness gradation display by being applied with a modulated signal; and a modulation circuit for generating a modulated signal modulated based on incoming drive data, wherein the modulation circuit generates such modulated signal that the difference in display brightness generated when making the display elements display by two modulated signals obtained based on the drive data having one gradation difference in a first range of gradations, which is part of the entire range of gradations of the incoming drive data, becomes smaller than the difference in display brightness in a second range of gradations, which is different from the first range of gradations, and wherein the modulation circuit performs the pulse width modulation preference type combined modulation, which is the combination of the pulse width modulation and the crest value modulation, for selecting at least two crest values for bringing the display element into the different ON-states based on the incoming drive data, wherein one of the two crest values is to be used as a crest value for the portion of the modulated signal in which the crest value is increased, which corresponds to the increased amount of the drive data in the first range of gradations, and the other one is to be used as a crest value for the portion of the modulated signal in which the crest value is increased, which corresponds to the increased amount of the drive data in the second range of gradations, and wherein a drive data converting unit for converting incoming data and outputting output signals as the drive data is provided in a previous stage of the modulation circuit, and the total number of gradations of the signals outputted from the drive data converting unit is smaller than the total number of gradations in data to be supplied into the drive data converting unit.

15. An image display apparatus according to claim 14, further comprising:

a signal processing circuit provided in a previous stage of the drive data conversion unit; and a non-linear conversion unit provided in a previous stage of the signal processing circuit, wherein the non-linear converting unit performs non-linear conversion for moderating non-linear conversion of a signal to be supplied into the non-linear conversion unit performed by a sender of the signal in order to obtain the signal.

16. An image display apparatus, comprising:

display elements, the display elements performing brightness gradation display by being applied with a modulated signal; and a modulation circuit for generating a modulated signal modulated based on incoming drive data, wherein the modulated circuit generates such modulated signal that the difference in display brightness generated when making the display elements display by two modulated signals obtained based on the drive data having one gradation difference in a first range of gradations, which is part of the entire range of gradations of the incoming drive data, becomes smaller than the difference in display brightness in a second range of gradations, which is different from the first range of gradations, and wherein pulse width control is performed on the waveform of the modulated signal by the slot width, and wherein crest value control is performed on crest values in each slot at least in n-stage from Al to An, where n is an integer number equal to or larger than two, and 0<A1<A2<. . . An, corresponding to the different ON-states of the display element, and wherein the waveform of the modulated signal having the portion rising to the predetermined crest value Ak, where k is an integer number between two and n inclusive, rises to the predetermined crest value Ak via the respective crest values from Ak-1 to A1 at least one slot each in sequence, and wherein a drive data converting unit for converting incoming data and outputting signals as the drive data is provided in a previous stage of the modulation circuit, and the total number of gradations of the signals outputted from the drive data converting unit is smaller than the total number of gradations in data to be supplied into the drive data converting unit.

17. An image display apparatus according to claim 16, further comprising:

a signal processing circuit provided in a previous stage of the drive data conversion unit; and a non-linear conversion unit provided in a previous stage of the signal processing circuit, wherein the non-linear converting unit performs non-linear conversion for moderating non-linear conversion of a signal to be supplied into the non-linear conversion unit performed by a sender of the signal in order to obtain the signal.

18. An image display apparatus, comprising:

display elements, the display elements performing brightness gradation display by being applied with a modulated signal; and a modulation circuit for generating a modulated signal modulated based on incoming drive data, wherein the modulated circuit generates such modulated signal that the difference in display brightness generated when making the display elements display by two modulated signals obtained based on the drive data having one gradation difference in a first range of gradations, which is part of the entire range of gradations of the incoming drive data, becomes smaller than the difference in display brightness in a second range of gradations, which is different from the first range of gradations, and wherein pulse width control is performed on the waveform of the modulated signal by the slot width, and wherein crest value control is performed on crest values in each slot at least in n-stages from A1 to An, where n is an integer number equal to or larger than two, and 0<A1<A2<. . . An, corresponding to the different ON-states of the display element, and wherein the waveform of the modulated signal having the portion falling from the predetermined crest value Ak, where k is an integer number between 2 and n inclusive, rises to the predetermined crest value Ak via the respective crest values from Ak-1 to A1 at least one slot each in sequence, and wherein a drive data converting unit for converting incoming data and outputting signals as the drive data is provided in a previous stage of the modulation circuit, and the total number of gradations of the signals outputted from the drive data converting unit is smaller than the total number of gradations in data to be supplied into the drive data converting unit.

19. An image display apparatus according to claim 18, further comprising:

a signal processing circuit provided in a previous stage of the drive data conversion unit; and a non-linear conversion unit provided in a previous stage of the signal processing circuit, wherein the non-linear converting unit performs non-linear conversion for moderating non-linear conversion of a signal to be supplied into the non-linear conversion unit performed by a sender of the signal in order to obtain the signal.

20. An image display apparatus, comprising:

display elements, the display elements performing brightness gradation display by being applied with a modulated signal; and a modulation circuit for generating a modulated signal modulated based on incoming drive data, wherein the modulated circuit generates such modulated signal that the difference in display brightness generated when making the display elements display by two modulated signals obtained based on the drive data having one gradation difference in a first range of gradations, which is part of the entire range of gradations of the incoming drive data, becomes smaller than the difference in display brightness in a second range of gradations, which is different from the first range of gradations, wherein pulse width control is performed on the waveform of the modulated signal by the slot width and crest value control is performed on crest value in each slot at least in n-stages from A1 to An, where n is an integer number equal to or larger than two, and 0<A1<A2<. . . An, wherein the waveform which is increased in gradation with respect to the predetermined waveform of the modulated signal has such a shape that a unit waveform block which is determined by the slot width and the crest value An-An-1, . . . or A2-A1, or the difference in crest value between the crest value A1 and the crest value which is a drive threshold of the light-emitting element, is added by priority to a point where the maximum crest value Ak including k=1 is lower and the maximum crest values continue by priority, wherein at least one of crest values is set to have a different display brightness from the case in which the crest values 0, A1, A2, . . . An-1, An are set to values to have a linear characteristic with respect to the display brightness, and wherein a drive data converting unit for converting incoming data and outputting signals as the drive data is provided in a previous stage of the modulation circuit, and the total number of gradations of the signals outputted from the drive data converting unit is smaller than the total number of gradations in data to be supplied into the drive data converting unit.

21. An image display apparatus according to claim 20, wherein the modulation waveform is such that the waveform obtained by increasing one more gradation and adding the unit waveform block to the waveform whereof a number of slots with the maximum crest value Ak is S-2(k-1), where the maximum slot value represented by S has a shape in which the crest value of any slot out of the K+1st to the S-kth slots is changed from Ak to Ak+1.

22. An image display apparatus according to claim 20, further comprising:

a signal processing circuit is provided in a previous stage of the drive data conversion unit; and a non-linear conversion unit provided in a previous stage of the signal processing circuit, wherein the non-linear converting unit performs non-linear conversion for moderating non-linear conversion of a signal to be supplied into the non-linear conversion unit performed by a sender of the signal in order to obtain the signal.

* * * * *